US011421956B1

(12) United States Patent
Robinson et al.

(10) Patent No.: US 11,421,956 B1
(45) Date of Patent: Aug. 23, 2022

(54) FIREARM ASSEMBLIES WITH A TRIGGER GUARD MAGAZINE GUIDE PORTION

(71) Applicant: WHG PROPERTIES, LLC, North Wales, PA (US)

(72) Inventors: Frank Robinson, Schwenksville, PA (US); William H. Geissele, Lower Gwynedd, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 17/172,649

(22) Filed: Feb. 10, 2021

(51) Int. Cl.
*F41A 19/11* (2006.01)
*F41A 9/70* (2006.01)
*F41A 3/66* (2006.01)

(52) U.S. Cl.
CPC ..... *F41A 19/11* (2013.01); *F41A 3/66* (2013.01); *F41A 9/70* (2013.01)

(58) Field of Classification Search
CPC .... F41A 19/11; F41A 9/23; F41A 9/24; F41A 9/25; F41A 3/66
See application file for complete search history.

(56) References Cited

U.S. PATENT DOCUMENTS 1,805,383 A 5/1931 Thiry
1,835,715 A 12/1931 McCoy
2,476,905 A 7/1949 Perry et al.
2,637,247 A 5/1953 Hester
2,912,781 A 11/1959 Lizza
3,651,736 A * 3/1972 Ingram ..... F41A 3/54 89/132
4,237,638 A 12/1980 Trexler
4,450,641 A 5/1984 Bullis et al.
4,573,280 A 3/1986 Malhotra
4,594,935 A 6/1986 Smith
4,815,226 A 3/1989 Ruger
5,628,134 A 5/1997 Wesp et al.
(Continued)

FOREIGN PATENT DOCUMENTS

CA 1319285 6/1993
CH 2285 9/1890
(Continued)

OTHER PUBLICATIONS

Strike Industries Fang Series Trigger Guard, May 23, 2019 [retrieved from Internet Jan. 3, 2022] <*Trigger Guards—AR—Products* (archive.org)>.

(Continued)

*Primary Examiner* — J. Woodrow Eldred
(74) *Attorney, Agent, or Firm* — Alston & Bird LLP

(57) ABSTRACT

Trigger guard assemblies that support and position a magazine within a firearm, firearms that include such assemblies, and associated components, assemblies, and methods are provided. An assembly may include at least a receiver and a trigger guard. The receiver may define a magazine well configured to support a magazine during a firearm operational cycle. The trigger guard may be connected to the receiver. The trigger guard may include a magazine guide portion that may be configured to contact the magazine supported by the receiver during at least a portion of the firearm operational cycle to resist rotation of the magazine relative to the magazine well.

29 Claims, 12 Drawing Sheets

(56) References Cited

U.S. PATENT DOCUMENTS

| | | | | |
|---|---|---|---|---|
| 5,899,013 | A | 5/1999 | Hauser et al. | |
| 7,076,902 | B2 | 7/2006 | Hengstenberg et al. | |
| 7,261,029 | B1 | 8/2007 | Davis | |
| D627,415 | S | 11/2010 | Finn | |
| 8,127,480 | B1 | 3/2012 | McManus et al. | |
| 8,434,253 | B2 | 5/2013 | Cain et al. | |
| 9,194,637 | B2 | 11/2015 | Mather | |
| 9,217,618 | B1 | 12/2015 | Miller, III | |
| D751,165 | S | 3/2016 | Miller | |
| D752,698 | S | 3/2016 | Miller | |
| D755,331 | S | 5/2016 | Eitan et al. | |
| 9,658,007 | B2 | 5/2017 | Withey | |
| 9,989,326 | B2 | 6/2018 | Larson, Jr. et al. | |
| 10,801,794 | B2 | 10/2020 | Geissele | |
| 11,073,350 | B2 | 7/2021 | Meier | |
| 2004/0128899 | A1 | 7/2004 | Hengstenberg et al. | |
| 2006/0265925 | A1 | 11/2006 | Murello | |
| 2010/0307042 | A1 | 12/2010 | Jarboe et al. | |
| 2012/0073176 | A1 | 3/2012 | McManus et al. | |
| 2012/0180360 | A1* | 7/2012 | Jones | F41A 3/66 42/75.03 |
| 2014/0165440 | A1* | 6/2014 | Mayerl | F41A 9/00 42/6 |
| 2014/0230398 | A1 | 8/2014 | Cook et al. | |
| 2015/0020423 | A1 | 1/2015 | Withey | |
| 2015/0354912 | A1* | 12/2015 | Miller, III | F41A 19/11 42/90 |
| 2017/0167814 | A1 | 6/2017 | Larson, Jr. et al. | |
| 2019/0162498 | A1* | 5/2019 | Amodio | F41A 19/11 |
| 2020/0300570 | A1 | 9/2020 | Robinson | |

FOREIGN PATENT DOCUMENTS

| | | |
|---|---|---|
| DE | 3136965 | 3/1983 |
| DE | 3305773 A1 | 9/1983 |
| ES | 1009264 Y | 1/1990 |
| TW | M419906 U | 1/2012 |
| TW | M419907 U | 1/2012 |

OTHER PUBLICATIONS

Vanhalla Tactikal Supply, [retrieved from Internet Jan. 3, 2022] <*Command Arms CAA TGMG Trigger Guard & Magazine Well Guide AR15* (3dcartstores.com)>.

* cited by examiner

FIREARM ASSEMBLIES WITH A TRIGGER GUARD MAGAZINE GUIDE PORTION

TECHNOLOGICAL FIELD

Example embodiments relate generally to trigger guard assemblies that support and position a magazine within a firearm, firearms that include such assemblies, and associated components, assemblies, and methods.

BACKGROUND

Tactical rifles and other types of firearms may be equipped with a lower receiver that includes a magazine well for holding a magazine during operation of the firearm. The magazine contains cartridges that are fed from the magazine to the chamber of the firearm during operational cycles. Actuation of the operational cycle of the firearm may be performed manually by an operator (e.g., a bolt action rifles) or by way of an autoloading action (e.g., automatic or semi-automatic rifles), such as a high pressure propellant gas. The lower receiver of a firearm may also be constructed with a trigger guard configured to prevent unintended actuation of the firearm's trigger.

The platforms underlying some firearm designs may be manufactured with different sizing for different cartridges; however, because the platform designs are otherwise generally fixed, many platforms cannot be adapted to fit certain cartridges for which the platform was not designed without either creating essentially a new firearm platform or causing the firearm to perform poorly. Through applied effort, ingenuity, and innovation, many of these identified problems have been solved by developing solutions that are included in embodiments of the present invention, many examples of which are described in detail herein.

BRIEF SUMMARY

The present disclosure generally relates to trigger guard assemblies that support and position a magazine for firearms.

According to some aspects of the present disclosure, there is provided an assembly for positioning a magazine within a firearm. The assembly may include at least a receiver and a trigger guard. The receiver may define a magazine well configured to support a magazine during a firearm operational cycle. The trigger guard may be connected to the receiver, and the trigger guard may include a magazine guide portion configured to contact the magazine supported by the receiver during at least a portion of the firearm operational cycle to resist rotation of the magazine relative to the magazine well.

The magazine guide portion may include a hardened material defining a first hardness that is greater than a second hardness of the receiver. In some embodiments, the hardened material may be attached to a remainder of the trigger guard. The hardened material (e.g., steel, etc.) may be press fit into an opening in the remainder of the trigger guard (e.g., comprising aluminum, etc.), the opening defining a slot along a width of the trigger guard through which a portion of the hardened material is configured to protrude. The one or more materials of the trigger guard may comprise one or more materials softer than the hardened material of the magazine guide portion. For example, the magazine guide portion may comprise a stainless-steel insert heat staked (e.g., press-fitting a part at an elevated temperature) into a polymer (e.g., polypropylene or the like) trigger guard. The magazine guide portion may comprise, for example, a hardened-steel insert integrated into a polymer trigger guard during an injection molding process to at least partially form the trigger guard. In some embodiments, the magazine guide portion may comprise a hardened material that is harder than the magazine.

In some embodiments, the receiver may include aluminum and the hardened material may include one or more of titanium, tungsten, steel, stainless steel, nickel, brass, bronze, or chromium. The magazine guide portion may, in some embodiments, protrude at least partially into the magazine well via a slot defined by the receiver. In some embodiments, the hardened material of the magazine guide portion may be one or more materials that are relatively harder than one or more materials of the magazine. For example, the hardened material of the magazine guide portion can be aluminum in an instance the body of the magazine comprises a softer material such as a polymer (e.g., polypropylene or the like). In some embodiments, the trigger guard and its magazine guide portion may be made of the same material as the lower receiver (e.g., aluminum).

In some embodiments, the trigger guard may include a forward portion and a rear portion, and the magazine guide portion may be defined at the forward portion of the trigger guard. The magazine guide portion may define a projection extending along a longitudinal axis of the trigger guard from a forward attachment feature of the trigger guard. The forward portion of the trigger guard may be configured with a forward attachment feature that includes a hole configured to receive a fastener for securing the trigger guard to the receiver. The rear portion of the trigger guard may be configured with a rear attachment feature that includes a hole configured to receive a fastener for securing the trigger guard to the receiver. The trigger guard may extend across a recess of the receiver configured to receive at least a trigger, and the trigger guard may be configured to prevent inadvertent actuation of the trigger.

In some embodiments, the magazine defining one or more feed lips may be configured to hold a cartridge in a loading position for receipt by a chamber of the firearm during the firearm operational cycle.

The assembly may also include a magazine catch configured to hold the magazine within the magazine well of the receiver. In some embodiments, the trigger guard may be configured to allow the magazine to release from the receiver when the magazine catch is released.

The firearm operational cycle may include a cartridge being stripped from the magazine by a bolt and fed into a chamber via a feed ramp defining a cartridge feed angle relative to a center axis of the chamber of the firearm, and wherein the feed ramp is configured to at least partially contact the cartridge during the firearm operational cycle and direct the cartridge into the chamber.

In some embodiments, the magazine guide portion may include a setscrew or a plug inserted into the trigger guard.

In some embodiments, the magazine guide portion may include an insert disposed at least partially within a remainder of the trigger guard. In some embodiments, the insert is molded into the trigger guard. In some embodiments, the insert is press fit or otherwise inserted into the trigger guard.

In some embodiments, the magazine guide portion includes an adjustable wear surface configured to be moved between two or more axial positions.

In some embodiments, the magazine guide portion comprises a roller configured to engage the magazine. In some embodiments, the magazine guide portion further comprises a spring configured to bias the roller towards the magazine.

In some embodiments, the roller is arranged on a shaft. In some embodiments, a space is defined between the shaft and the interior surface of the roller to allow the spring to move the roller relative to the shaft.

According to some aspects of the present disclosure, a trigger guard for a firearm is provided. The trigger guard may include a magazine guide portion configured to attach to a receiver of the firearm. The magazine guide portion may be configured to contact a magazine supported by the receiver during at least a portion of the firearm operational cycle to resist rotation of the magazine relative to the magazine well.

In some embodiments, the trigger guard further defines a forward attachment hole and a rearward attachment hole each configured to receive a fastener therethrough for securing the trigger guard to the receiver. The magazine guide portion may define a projection extending along a longitudinal axis of the trigger guard from the forward attachment feature of the trigger guard.

The magazine guide portion may include a hardened material attached to a remainder of the trigger guard.

According to some further aspects of the present disclosure, a firearm may be provided. The firearm may include at least a receiver and a trigger guard connected to the receiver. The receiver may define a magazine well configured to support a magazine during a firearm operational cycle. The trigger guard may be connected to the receiver. The trigger guard may include a magazine guide portion configured to contact the magazine supported by the receiver during at least a portion of the firearm operational cycle to resist rotation of the magazine relative to the magazine well.

In some embodiments, the firearm further comprises the magazine and a magazine catch. The magazine may be disposed in the magazine well and held by the magazine catch. In some embodiments, a clearance is defined between at least a portion of the magazine and at least a portion of the magazine well. The magazine may be prevented from rotating into at least a portion of the clearance by the magazine guide portion of the trigger guard.

In some embodiments, a method of manufacturing a trigger guard for a firearm may be provided. The method may include forming the trigger guard including forming a magazine guide portion. The trigger guard may be configured to attach to a receiver of the firearm. The magazine guide portion may be configured to contact a magazine supported by the receiver during at least a portion of the firearm operational cycle to resist rotation of the magazine relative to the magazine well. In some embodiments, the trigger guard may be formed via manufacturing processes including, but not limited to, milling, forging, additive manufacturing, molding, any other manufacturing process described herein or any combination thereof.

In some embodiments, a method of manufacturing an assembly for positioning a magazine within a firearm may be provided. The method may include performing a method of manufacturing a trigger guard for a firearm according to any embodiment discussed herein, including in the preceding paragraph. The method may further include connecting the trigger guard to a receiver defining a magazine well configured to support a magazine during a firearm operational cycle.

In some embodiments, a method of manufacturing a firearm may be provided. The method may include performing a method of manufacturing an assembly for positioning a magazine within a firearm according to any embodiment discussed herein, including in the preceding paragraphs. The method may further include connecting the assembly directly or indirectly with at least a bolt carrier group, a trigger assembly, and a gas delivery system.

A variety of additional aspects are also described in the following detailed description and in the attached claims. The aspects can relate to individual features and to combinations of features. It is to be understood that both the foregoing general description and the following detailed description are exemplary and explanatory only and are not restrictive of the broader inventive concepts upon which the example embodiments disclosed herein are based.

BRIEF DESCRIPTION OF THE DRAWINGS

Having thus described embodiments of the disclosure in general terms, reference will now be made to the accompanying drawings, which are not necessarily drawn to scale. The following drawings are illustrative of particular embodiments of the present disclosure and do not limit the scope of the present disclosure. Moreover, the drawings are intended for use in conjunction with the explanations provided herein. Example embodiments of the present disclosure will hereinafter be described in conjunction with the appended drawings.

Figure 1:
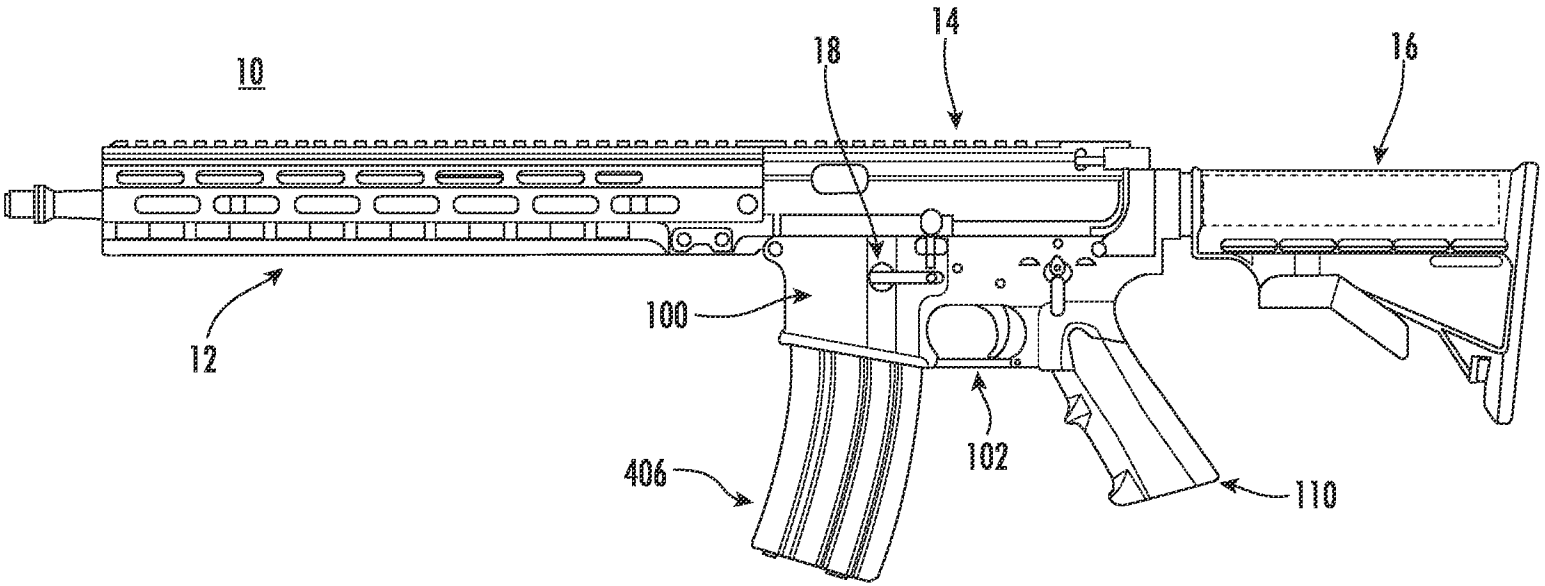

FIG. 1 is a side view of a firearm according to some example embodiments.

Figure 2:
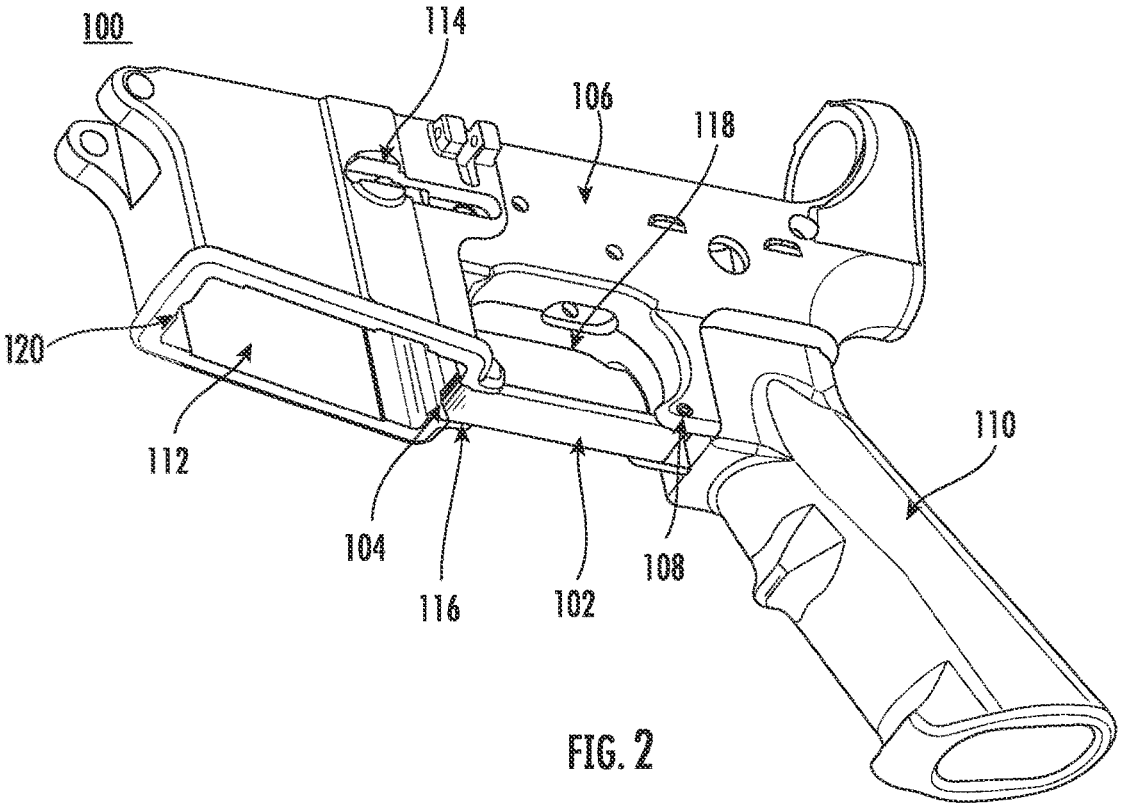

FIG. 2 is a side isometric view of a lower receiver assembly, according to some example embodiments.

Figure 3:
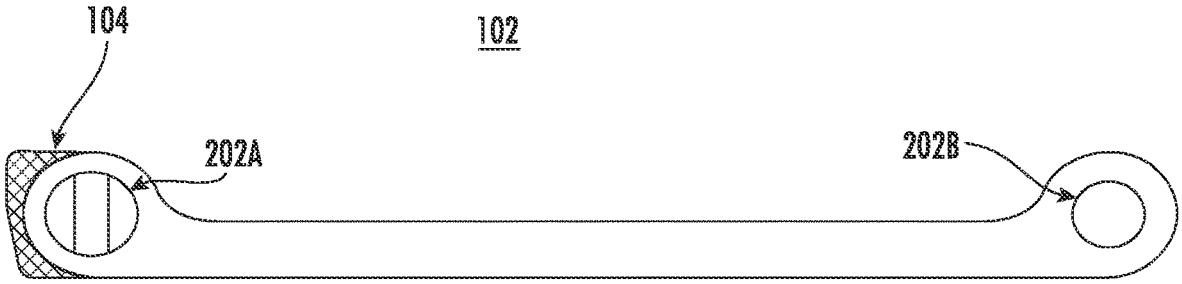

FIG. 3 is a side view of a trigger guard, according to some example embodiments.

Figure 4:
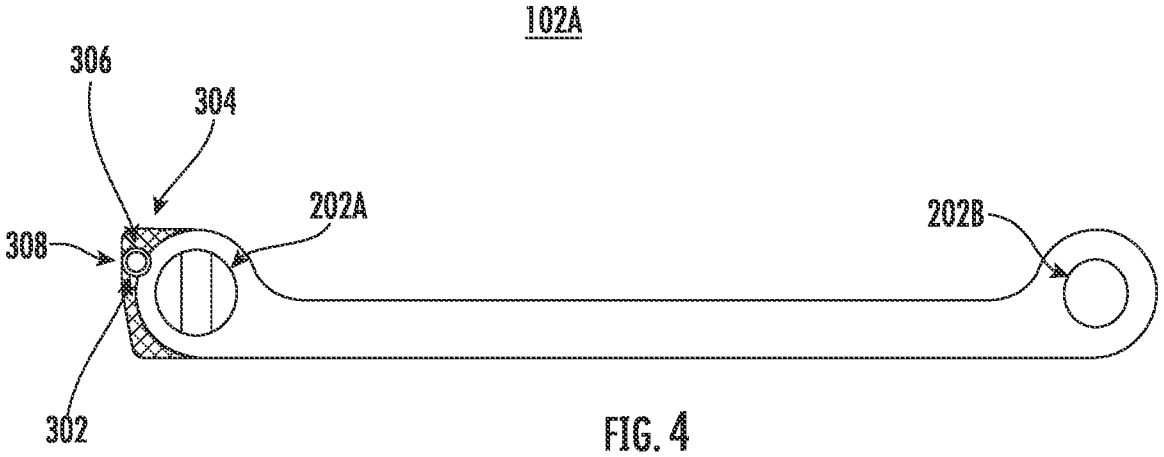

FIG. 4 is a side view of a trigger guard, according to some example embodiments.

Figure 5:
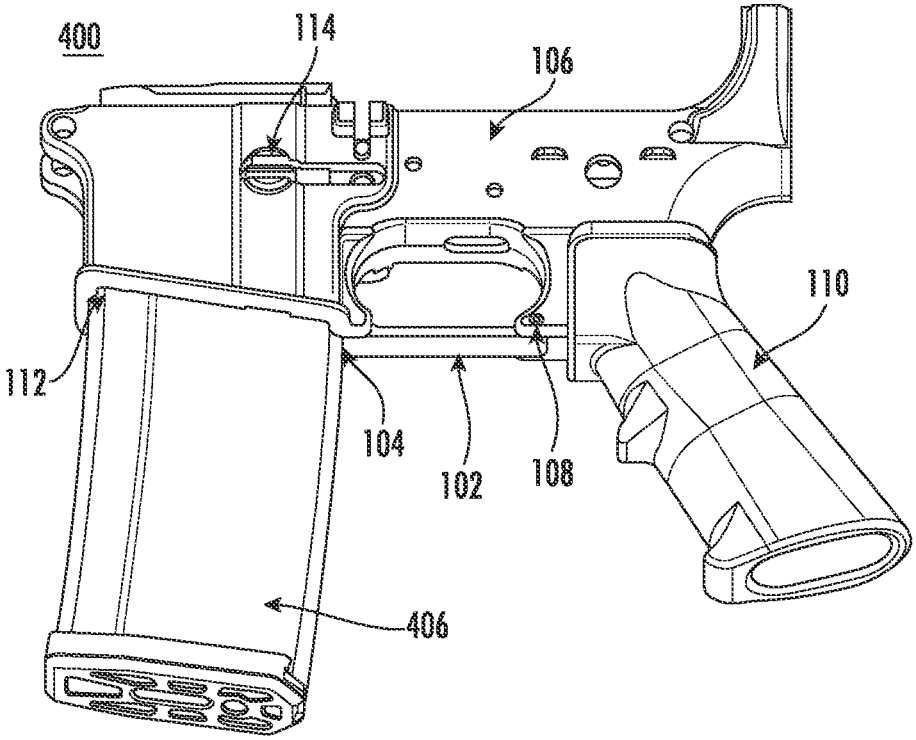

FIG. 5 is a side isometric view of a lower receiver assembly with a magazine, according to some example embodiments.

Figure 6:
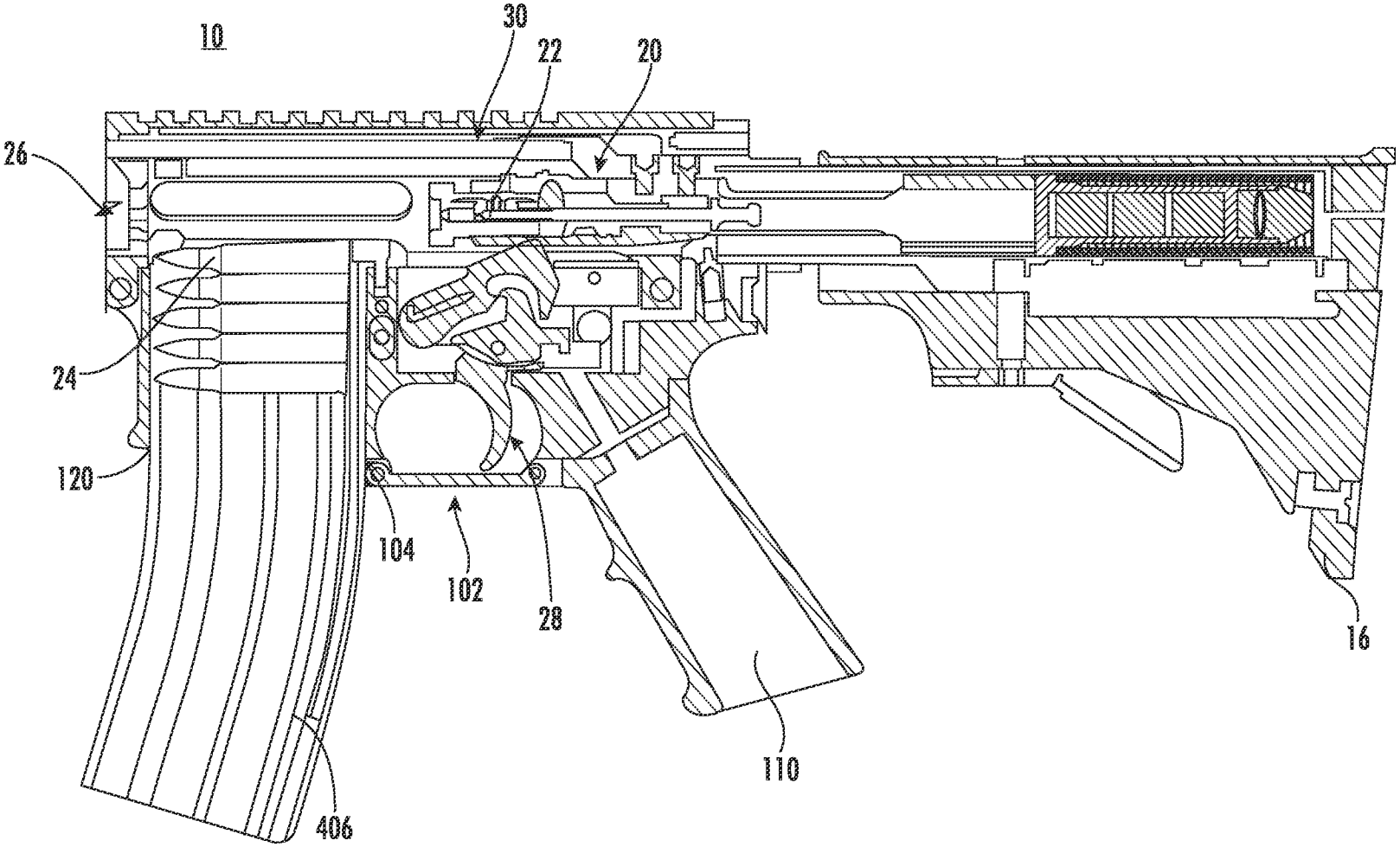

FIG. 6 is a cross-sectional view of a portion of the firearm of FIG. 1.

Figure 7A:
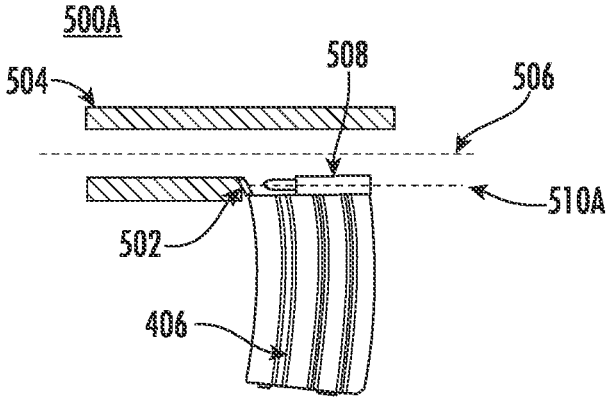

FIG. 7A is a cross-sectional, schematic side view of an example firearm equipped with a magazine, according to some example embodiments.

Figure 7B:
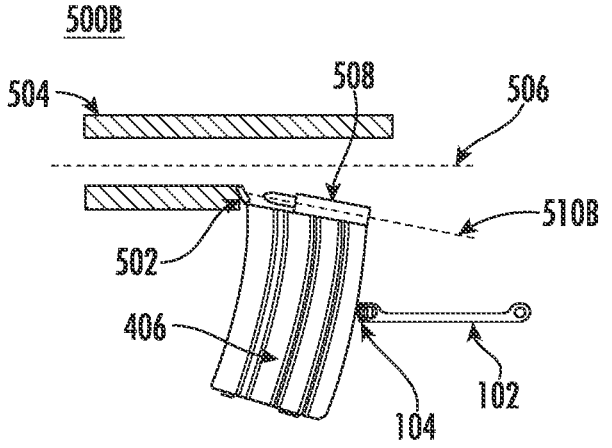

FIG. 7B is a cross-sectional, schematic side view of an example firearm equipped with a magazine, according to some example embodiments.

Figure 8A:
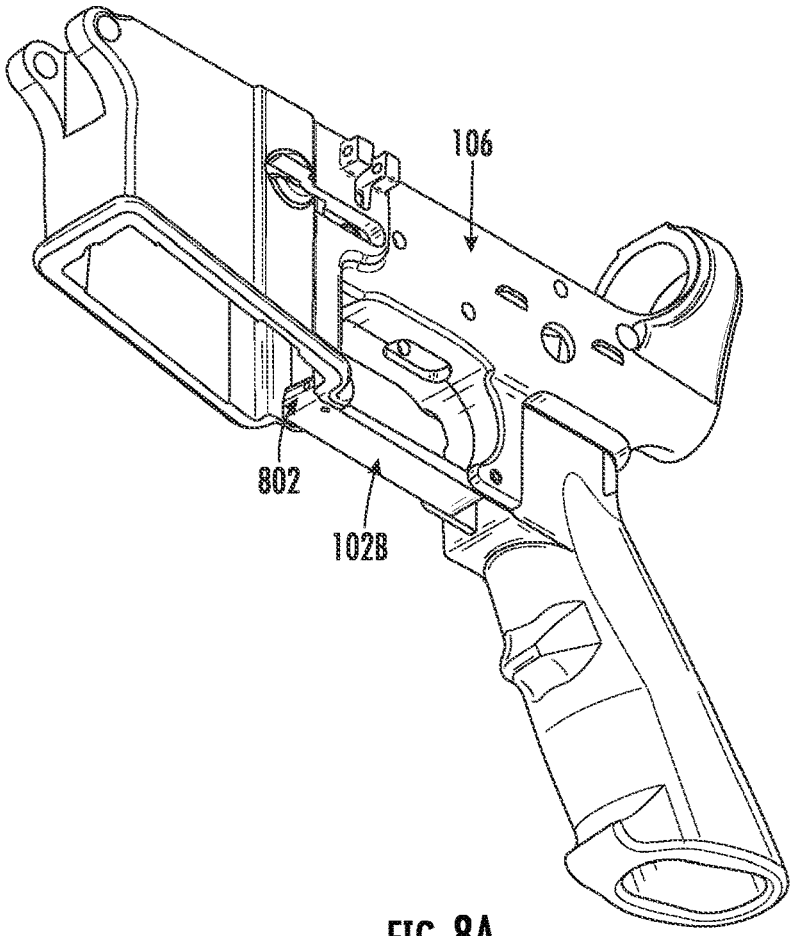

FIG. 8A is a side isometric view of a lower receiver assembly, according to some example embodiments.

Figure 8B:
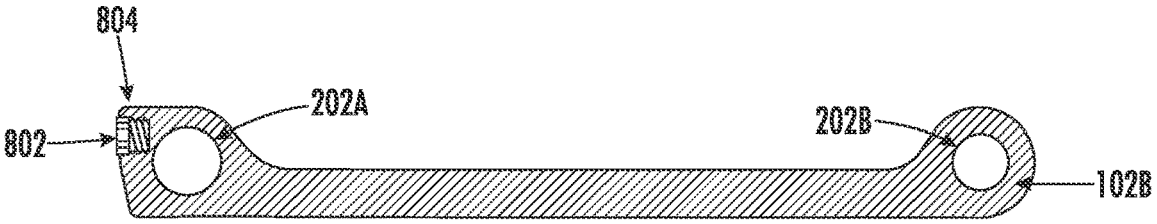

FIG. 8B is a cross-sectional view of a trigger guard of the lower receiver assembly of FIG. 8A.

Figure 8C:
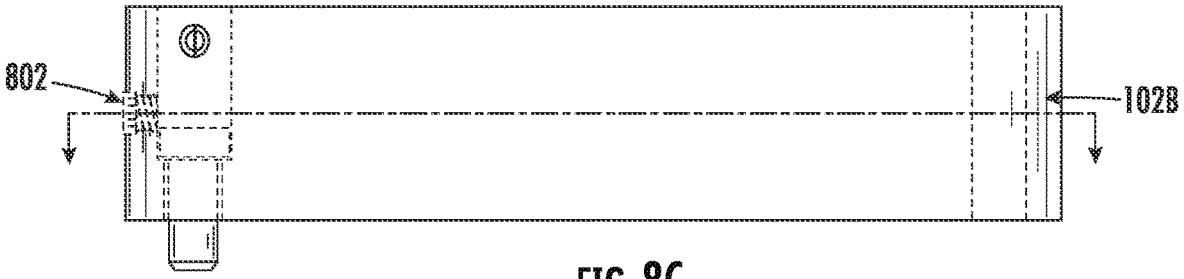

FIG. 8C is a bottom view of a trigger guard of the lower receiver assembly of FIG. 8A.

Figure 9A:
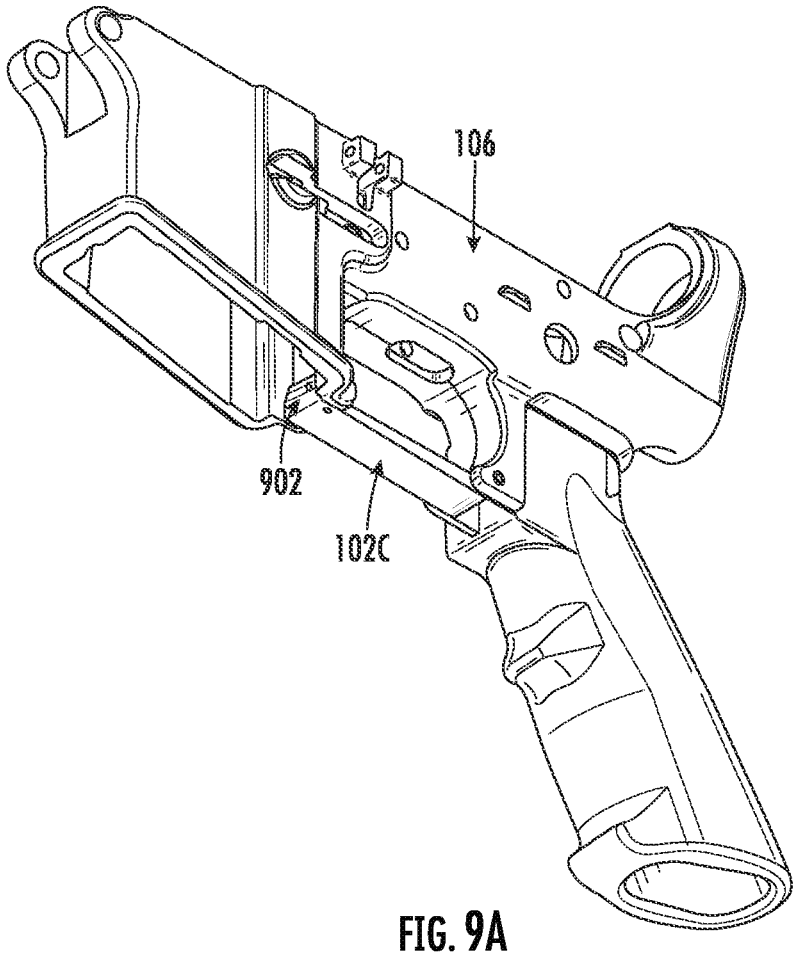

FIG. 9A is a side isometric view of a lower receiver assembly, according to some example embodiments.

Figure 9B:
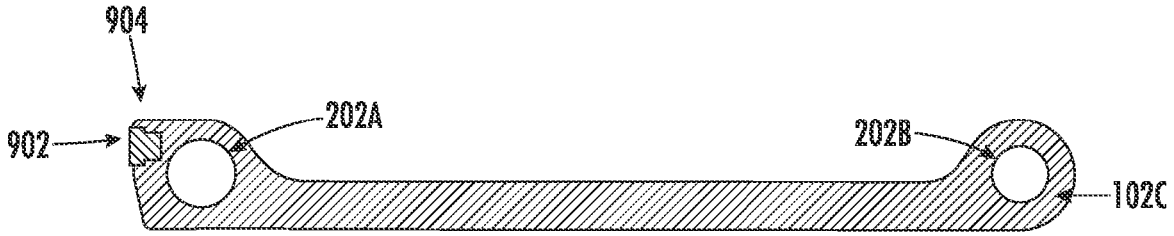

FIG. 9B is a cross-sectional view of a trigger guard of the lower receiver assembly of FIG. 9A.

Figure 9C:
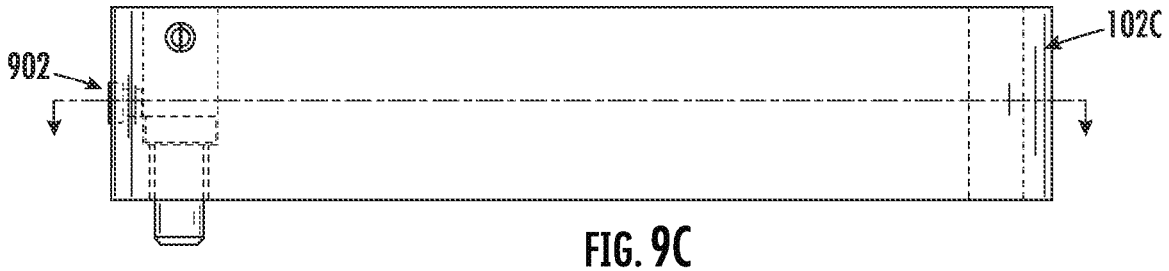

FIG. 9C is a bottom view of a trigger guard of the lower receiver assembly of FIG. 9A.

Figure 10A:
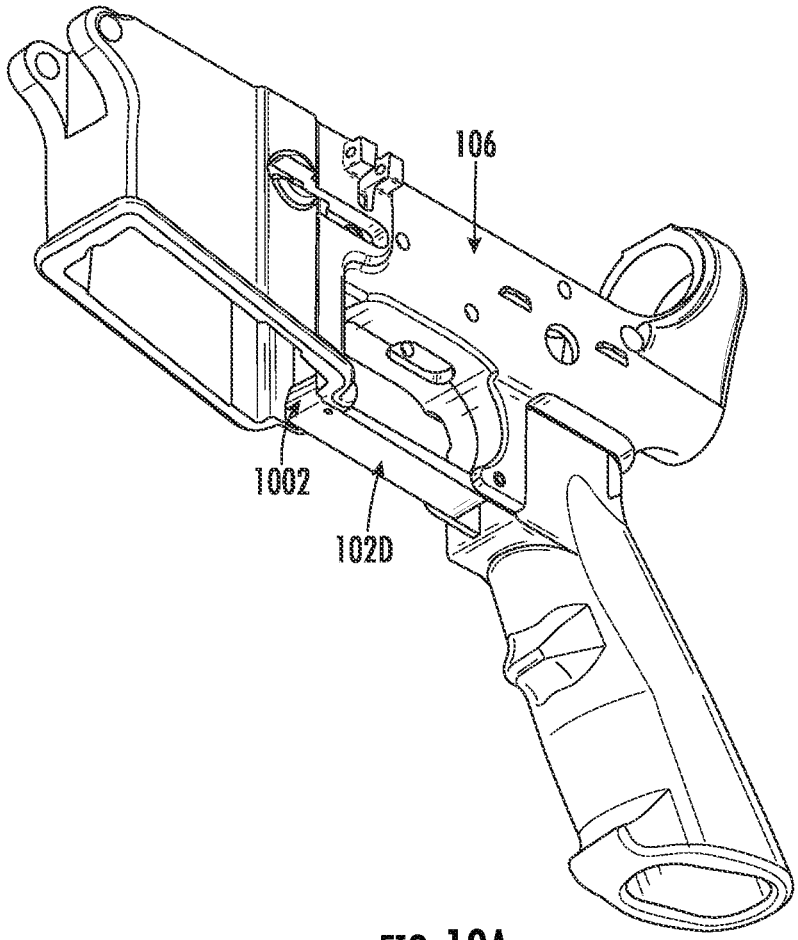

FIG. 10A is a side isometric view of a lower receiver assembly, according to some example embodiments.

Figure 10B:
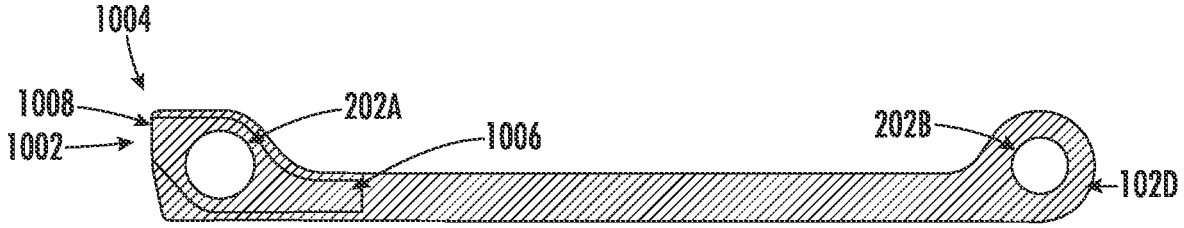

FIG. 10B is a cross-sectional view of a trigger guard of the lower receiver assembly of FIG. 10A.

Figure 10C:
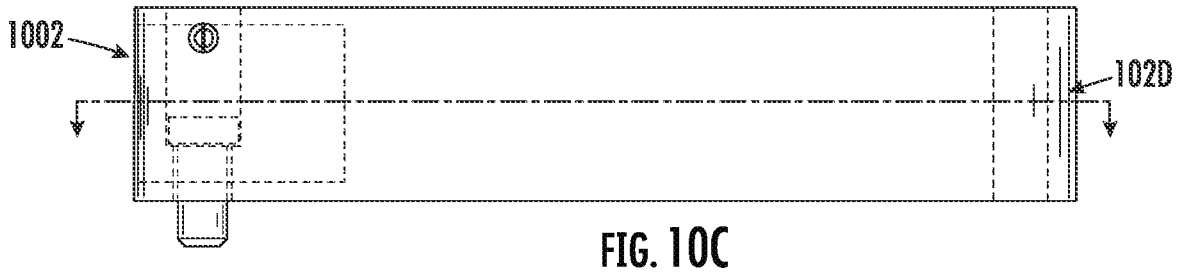

FIG. 10C is a bottom view of a trigger guard of the lower receiver assembly of FIG. 10A.

Figure 11A:
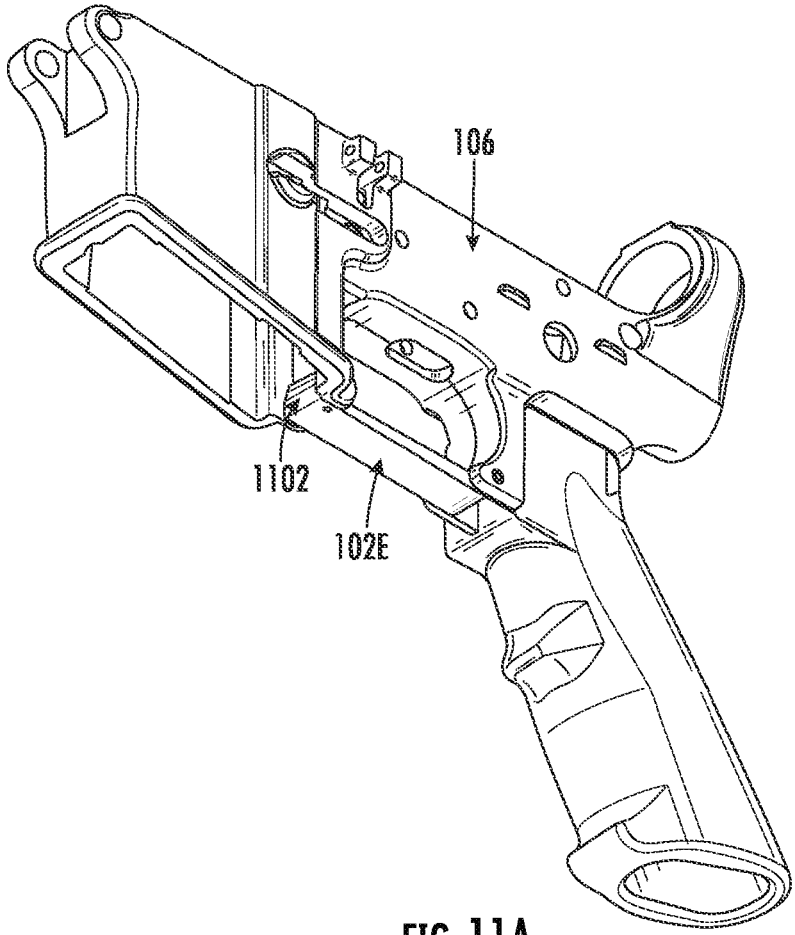

FIG. 11A is a side isometric view of a lower receiver assembly, according to some example embodiments.

Figure 11B:
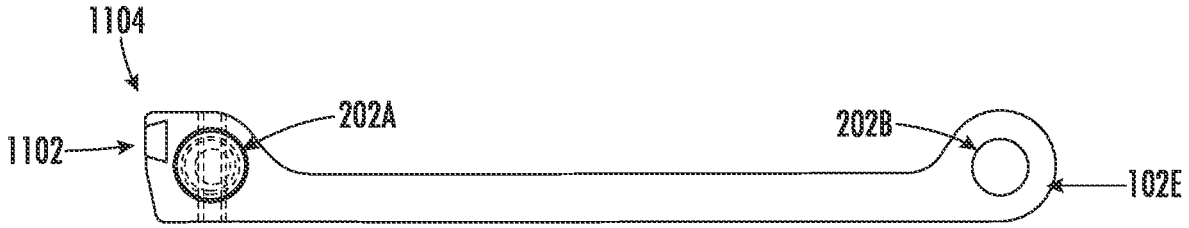

FIG. 11B is a cross-sectional view of a trigger guard of the lower receiver assembly of FIG. 11A.

Figure 11C:
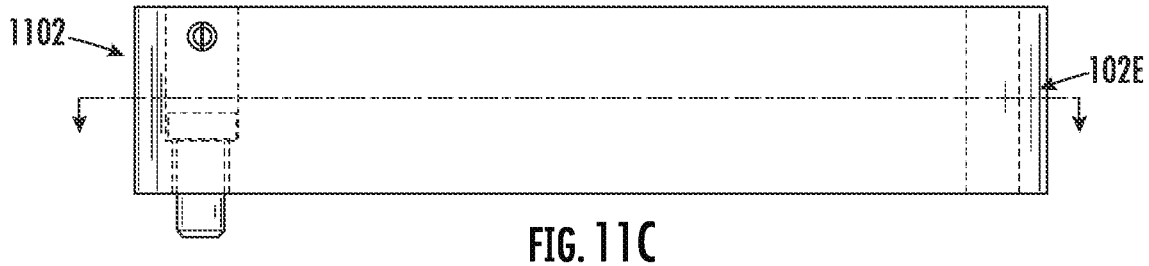

FIG. 11C is a bottom view of a trigger guard of the lower receiver assembly of FIG. 11A.

Figure 12A:
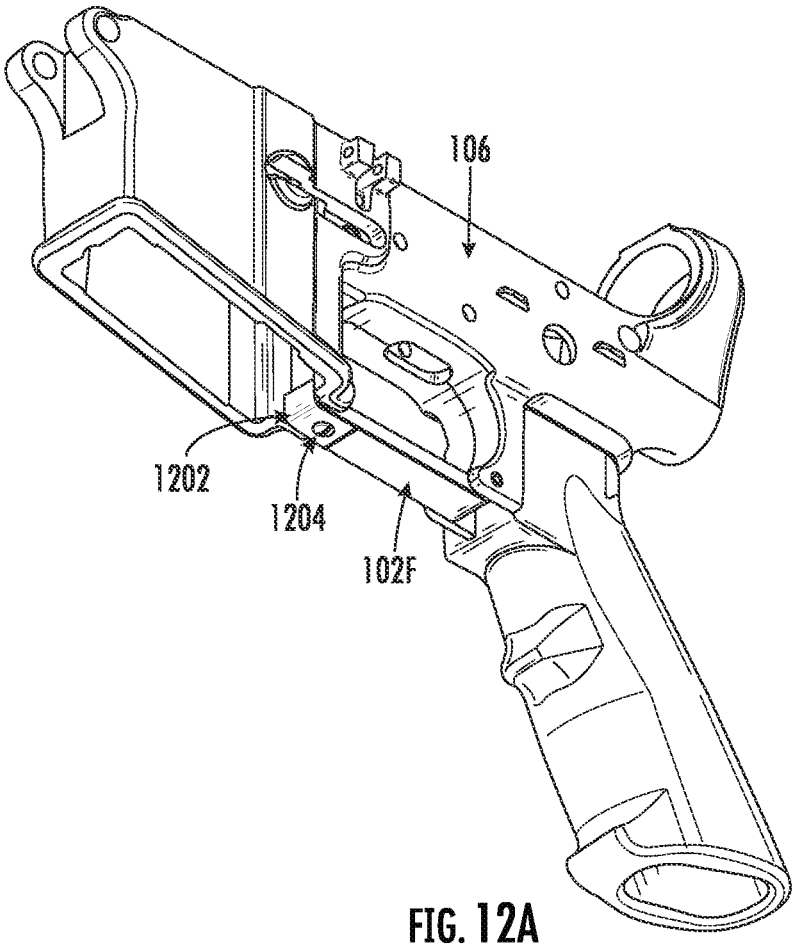

FIG. 12A is a side isometric view of a lower receiver assembly, according to some example embodiments.

Figure 12B:
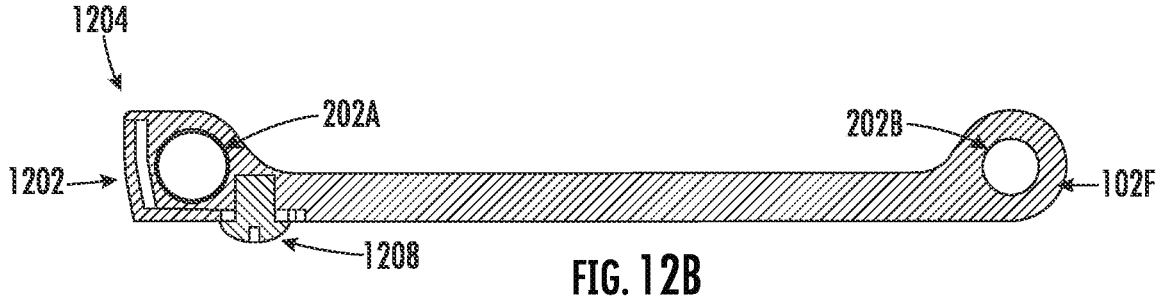

FIG. 12B is a cross-sectional view of a trigger guard of the lower receiver assembly of FIG. 12A.

Figure 12C:
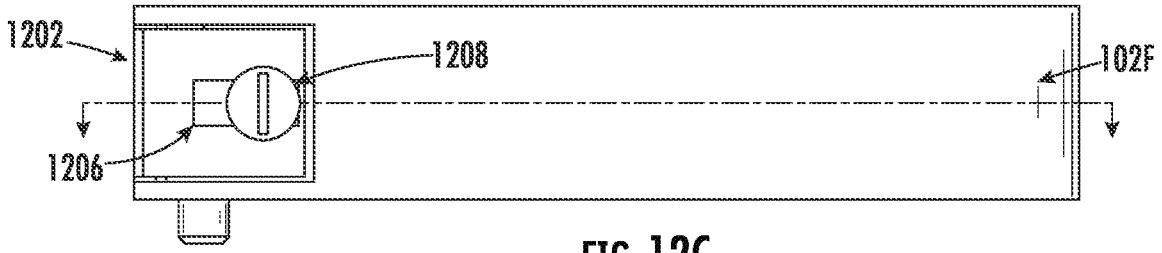

FIG. 12C is a bottom view of a trigger guard of the lower receiver assembly of FIG. 12A.

Figure 13A:
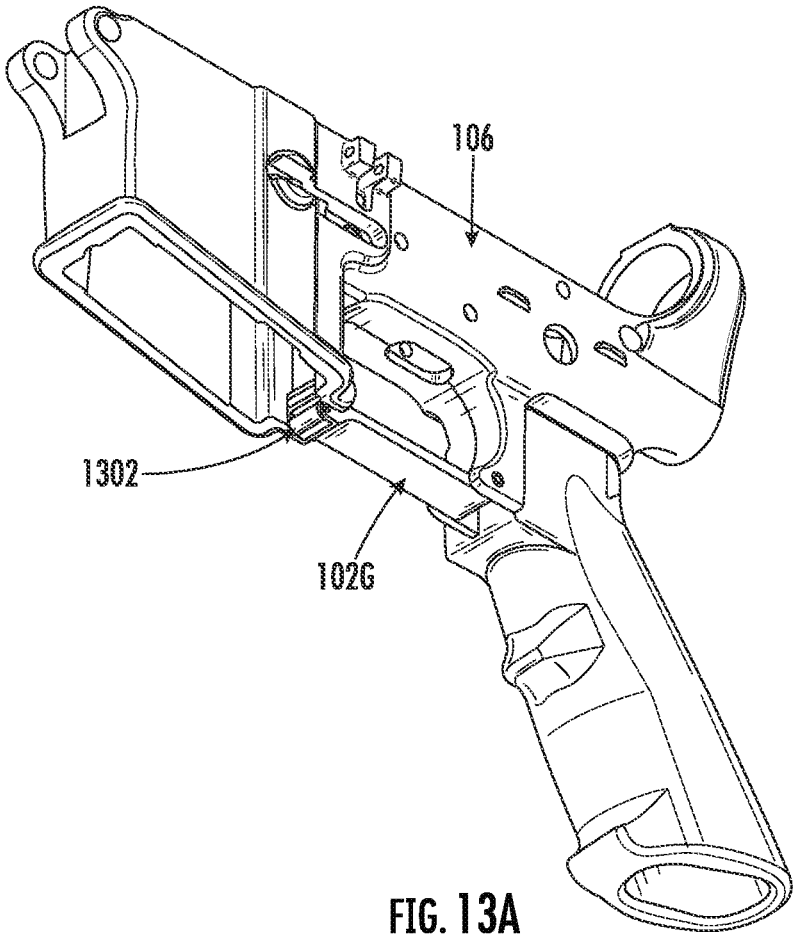

FIG. 13A is a side isometric view of a lower receiver assembly, according to some example embodiments.

Figure 13B:
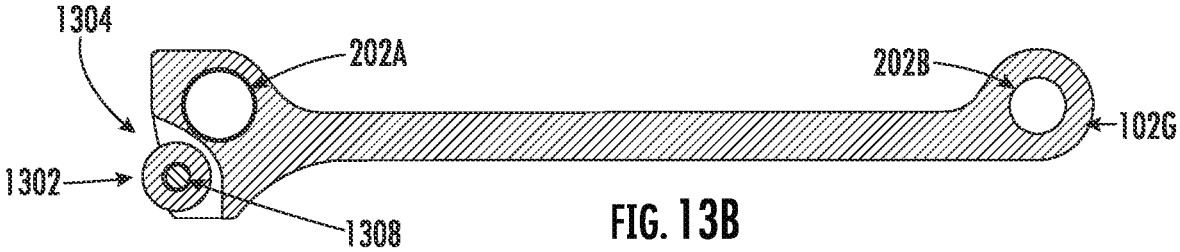

FIG. 13B is a cross-sectional view of a trigger guard of the lower receiver assembly of FIG. 13A.

Figure 13C:
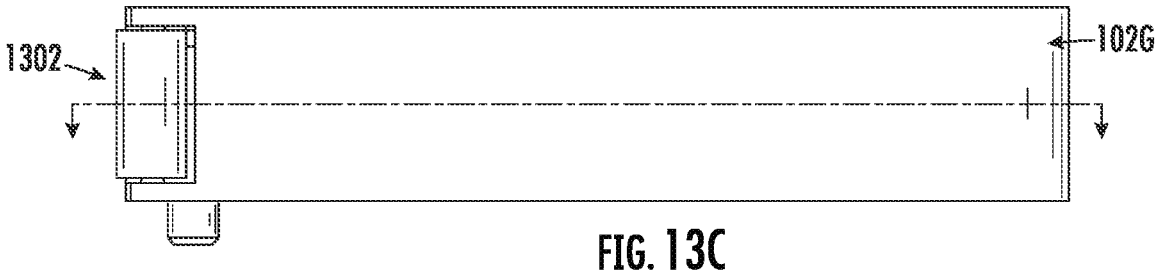

FIG. 13C is a bottom view of a trigger guard of the lower receiver assembly of FIG. 13A.

Figure 14A:
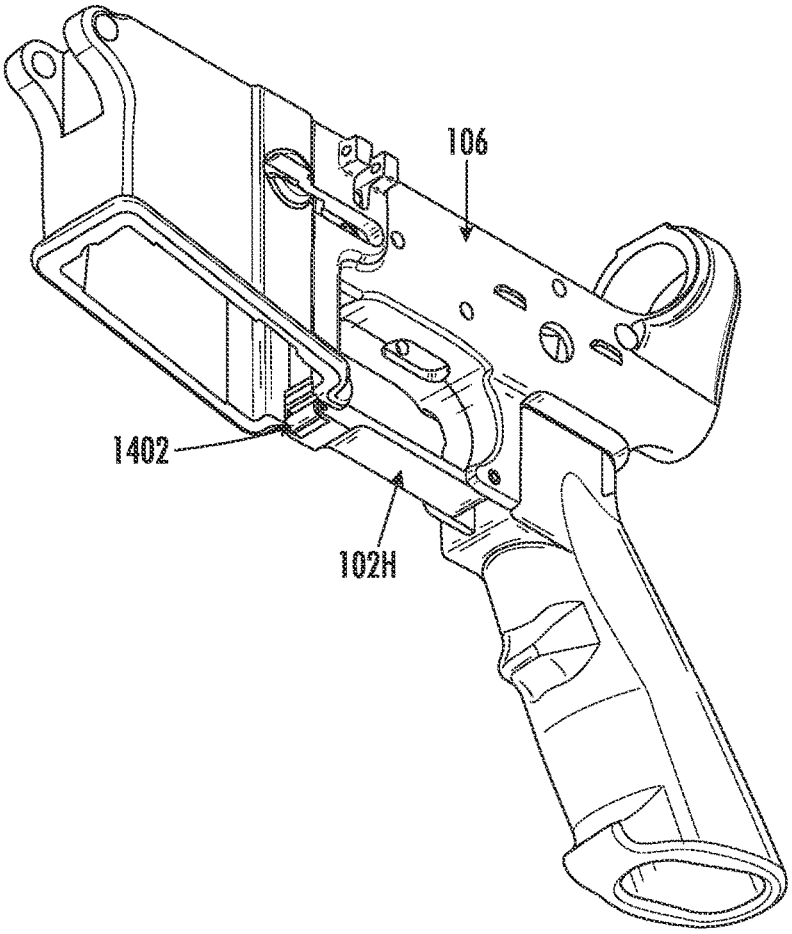

FIG. 14A is a side isometric view of a lower receiver assembly, according to some example embodiments.

Figure 14B:
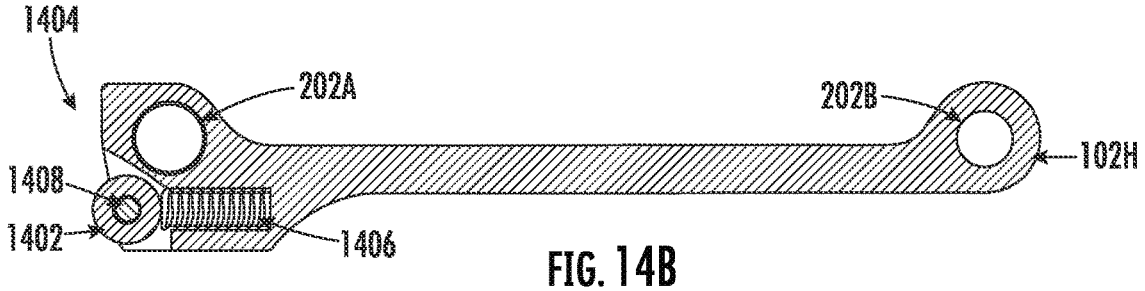

FIG. 14B is a cross-sectional view of a trigger guard of the lower receiver assembly of FIG. 14A.

Figure 14C:
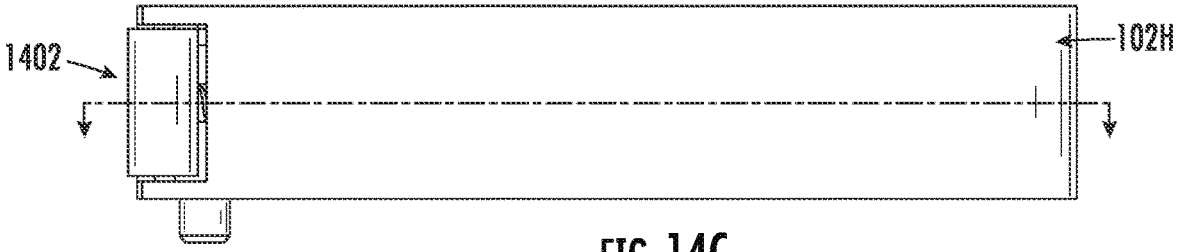

FIG. 14C is a bottom view of a trigger guard of the lower receiver assembly of FIG. 14A.

DETAILED DESCRIPTION

Some embodiments of the present invention will now be described more fully hereinafter with reference to the accompanying drawings, in which some, but not all, embodiments of the invention are shown. Like reference numerals refer to like elements throughout. Indeed, various embodiments of the invention may be embodied in many different forms and should not be construed as limited to the embodiments set forth herein. Rather, these embodiments are provided so that this disclosure will satisfy applicable legal requirements.

As used herein, the term "or" is used in both the alternative and conjunctive sense, unless otherwise indicated. The term "along," and similarly utilized terms, means near or on, but not necessarily requiring directly on an edge or other referenced location. The terms "approximately," "generally," and "substantially" refer to within manufacturing and/or engineering design tolerances for the corresponding materials and/or elements unless otherwise indicated. Thus, use of any such aforementioned terms, or similarly interchangeable terms, should not be taken to limit the spirit and scope of embodiments of the present invention.

The figures are not drawn to scale and are provided merely to illustrate the instant example embodiments. The figures do not limit the scope of the present disclosure or the appended claims. Several aspects of the example embodiments are described below with reference to example applications for illustration. It should be understood that numerous specific details, relationships, and methods are set forth to provide a full understanding of the example embodiments. One having ordinary skill in the relevant art, however, will readily recognize that the example embodiments can be practiced without one or more of the specific details or with other methods. In other instances, well-known structures and/or operations are not shown in detail to avoid obscuring the example embodiments.

With reference to FIG. 1, the present disclosure relates to trigger guard assemblies for supporting and positioning a magazine 406 relative to a firearm 10, and associated firearms, magazines, and other components and methods. Example embodiments of the present disclosure may include a firearm comprising one or more of a barrel 12; an upper receiver 14; a lower receiver assembly 100; a magazine 406; a grip 110; a trigger guard; an action, including a bolt carrier group (e.g., bolt, firing pin, ejector, etc.) (shown in FIG. 6); an autoloading system (e.g., gas delivery system (gas direct gas impingement, gas piston, etc.) such as the gas delivery system 30 shown in FIG. 6, recoil-driven autoloader, inertia-driven autoloader, etc.), buttstock 16, magazine catch 18, and/or the like.

According to some embodiments, a magazine 406 may be held in a magazine well 112 (labeled in FIG. 2) defined by a lower receiver 106 of the firearm. The magazines 406 and the magazine well 112 may include a clearance that may allow the magazine to drop free when released while also holding the magazine in a stable position. This stable positioning may allow a cartridge to be stripped from the top of the magazine and fed smoothly into the chamber as the firearm cycles. However, for a given platform (e.g., an AR-15® platform), the firearm may be chambered for a cartridge that has a much different shape than the platform was originally designed for. This difference in shape may cause fouling or other malfunctions caused by the clearance and orientation of the magazine, such as the cartridges being driven into areas around the feed ramps and barrel instead of feeding smoothly into the chamber. The solutions of the present disclosure include structures for modifying the clearance and orientation of the magazine 406 held by a firearm 10 to accommodate cartridges of ammunition having varying sizes and shapes (e.g., in some embodiments, cartridges for which the firearm was not necessarily designed). These structures may include a trigger guard and related trigger guard assemblies configured to support and position the magazine.

With reference to FIG. 2, in various embodiments, the trigger guard 102 comprises a magazine guide portion 104 that may contact a magazine inserted into and/or supported by a magazine well 112 of a lower receiver 106. The trigger guard 102 may extend across a recess 118 of the receiver in which the trigger is configured to be disposed to protect the trigger from accidental contact and inadvertent actuation of the trigger. The depicted receiver 106 defines a slot 116 between the trigger guard and magazine well 112, which allows the magazine guide portion to project towards the magazine well. The magazine guide portion 104 of the trigger guard may be configured to resist movement of the magazine 406 (shown in FIG. 1) during operational cycles of the firearm that impede the loading of a cartridge into the chamber of the firearm 10 (labelled in FIG. 1). In some embodiments, the magazine guide portion 104 may press against the magazine 406 (shown in FIG. 1) when the magazine is inserted in the magazine well to hold the magazine at a different position within a vertical, lengthwise plane of the firearm 10 (labelled in FIG. 1). As described herein, the magazine guide portion 104 may apply a force to the magazine at all times that the magazine 406 (shown in FIG. 1) is held in the magazine well by the receiver (e.g., continual repositioning) or may apply a force to the magazine only or primarily when the magazine shifts from a neutral position, such as during a firing and cycling operation of the firearm and/or any time the magazine shifts from the neutral position.

For example, during operation of a firearm, recoil forces, cycling forces, or the like (e.g., operator movements such as running or positioning the firearm, etc.) may cause a magazine supported by the lower receiver within the magazine well to shift (e.g., translate and/or rotate) forward or rearward. Such forward or rearward movements of the magazine can change the feed angle of the next cartridge causing the next cartridge to fail to properly chamber within the firearm as the bolt moves forward to strip the cartridge from the magazine while the magazine is out of position. In some embodiments, contact between the bolt and cartridge may cause the magazine holding the cartridge to rotate forward as the round is stripped from the magazine and fed towards the chamber. Example embodiments comprising a trigger guard with a magazine guide portion resist movement of the magazine within the lower receiver's magazine well and keep the cartridge aligned with a more favorable feed angle such that the probability of each cartridge chambering properly is increased. The inventive principles disclosed herein can be applied to other types of firearms having magazines, including but not limited to other types of rifles, shotguns, and/or pistols.

With continued reference to FIG. 2, a side isometric view of a lower receiver assembly 100 is illustrated, according to some example embodiments. The lower receiver assembly 100 is illustrated with a trigger guard 102, comprising the magazine guide portion 104, attached to lower receiver 106 by way of at least fastener 108. As shown, fastener 108 is located in the rearward portion of trigger guard 102 and connects trigger guard 102 to a rearward portion of the lower receiver 106 near grip 110. In some embodiments, another fastener (e.g., attached on the opposite side of the receiver and threaded into the receiver) may be located in the forward portion of trigger guard 102 and may connect trigger guard 102 to a forward portion of lower receiver 106 near magazine well 112, such that the trigger guard may be rigidly fixed to the lower receiver 106. In some embodiments, fastener 108 may comprise one or more of a screw, a threaded barrel, a roll pin, a detent pin, or the like. The lower receiver 106 may retain the magazine in the magazine well 112 via the magazine catch 18 (shown in FIG. 1) that engages the magazine 406 (shown in FIG. 1) through a magazine catch receiving opening 114. The magazine 406 may define a corresponding locking feature (e.g., a hole, slot, or the like) to receive the magazine catch. In some embodiments, the magazine may pivot at least partially about a pivot point 120 defined at the front, lower edge of the magazine well 112 upon application of force from the trigger guard 102 according to any of the embodiments disclosed herein.

As shown, magazine guide portion 104 at least partially protrudes into the magazine well 112. In some embodiments, lower receiver assembly 100 may comprise one or more of a buffer tube subassembly, stock subassembly, a trigger assembly, a magazine catch 18 (shown in FIG. 1), a bolt locking and release mechanism, a magazine 406 (shown in FIG. 1) configured for one or more cartridge types or the like as would be appreciated by a person of ordinary skill in the art in light of the present disclosure. In some embodiments, lower receiver assembly 100 may be configured to operably attach to one or more upper receiver assemblies (e.g., upper receiver assembly 14 shown in FIG. 1) and/or other firearm components.

FIG. 3 illustrates a side view of a trigger guard 102 according to some example embodiments. In the depicted embodiment, the trigger guard 102 includes a magazine guide portion 104 at one end. The magazine guide portion 104, as illustrated, is configured to extend forward (e.g., towards the left of the page of FIG. 3) from the forward portion of the trigger guard 102 along a longitudinal axis defined along the length dimension of the trigger guard 102. As described herein, the magazine guide portion 104 is configured to extend towards the magazine when assembled with the firearm. In some embodiments, the magazine guide portion 104 may be at least partially or completely integrated into trigger guard 102. For example, in some embodiments the trigger guard 102, including the magazine guide portion 104, may be made of a single piece of material (e.g., machined from a solid block of steel, aluminum, or titanium). In some embodiments, the magazine guide portion 104 may at least partially comprise a part connected to trigger guard 102 (e.g., an extrusion welded or otherwise attached to trigger guard 102, etc.).

The trigger guard 102 is also illustrated with a forward attachment feature 202A and a rearward attachment feature 202B. In the depicted embodiment, the body of the trigger guard between the attachment features 202A, 202B is substantially linear and defines a flat lower surface, and in some embodiments, the body of the trigger guard may be any other shape known in the art. In some embodiments, the forward attachment feature 202A may comprise a hole configured to accept a fastener, such as a pin (e.g., a roll pin, a detent pin, etc.), a screw, a threaded rod, or the like to connect the trigger guard 102, 102A-102H to a lower receiver (e.g., lower receiver assembly 100 or the like). In some embodiments, the rearward attachment feature 202B may comprise a hole configured to accept a fastener, such as a pin (e.g., a roll pin, a detent pin, etc.), a screw, a threaded rod, or the like to connect the trigger guard 102, 102A-102H to a lower receiver (e.g., as part of lower receiver assembly 100 or the like). In various embodiments, the trigger guard 102, 102A-102H may be permanently or temporarily attached to or integrated into the receiver 106 via any means known in the art.

In some embodiments, at least a portion of the trigger guard 102, 102A-102H, including a portion of the magazine guide portion 104, comprises a hardened material defining a first hardness that is greater than a second hardness defined by a magazine (e.g., the magazine 406 shown in FIG. 5). In some embodiments, at least a portion of the trigger guard 102, 102A-102H, including a portion of the magazine guide portion 104, comprises a hardened material defining a first hardness that is greater than a second hardness defined by the lower receiver 106 (shown in FIGS. 1-2). In some embodiments, the magazine guide portion 104 comprises one or more of titanium, tungsten, steel, stainless steel, aluminum, nickel, brass, bronze, chromium, the like, or combinations thereof. In some embodiments, the trigger guard 102, or the like, including any variations of the trigger guard 102A-102H discussed herein, comprises one or more of titanium, tungsten, steel, stainless steel, aluminum, nickel, brass, bronze, chromium, polymers, the like, or combinations thereof. In one embodiment, the trigger guard 102, 102A-102H, including the magazine guide portion 104, is made as a single titanium piece. In some embodiments, at least a portion of the trigger guard 102, 102A-102H, including a portion of the magazine guide portion 104, comprises steel. In some embodiments, at least a portion of the trigger guard 102, 102A-102H, including a portion of the magazine guide portion 104, comprises aluminum and at least a portion of the magazine comprises polymer.

FIG. 4 illustrates a side view of another embodiment of a trigger guard 102A according to some example embodiments. Except stated otherwise, the trigger guard 102A of FIG. 4 may generally have the same structure, purpose, properties, and function as any other trigger guard discussed herein, and the trigger guard 102A may be interchangeable in whole or in part with any trigger guard of any other embodiment. As shown in FIG. 4, the trigger guard 102A may include a magazine guide portion 304 that includes a hardened wear surface 302 configured to resist wear caused by the magazine contacting the trigger guard 102A. The magazine guide portion 304, as illustrated, is configured to extend forward (e.g., towards the left of the page of FIG. 4) from the forward portion of the trigger guard 102A along a longitudinal axis defined along the length dimension of the trigger guard 102A. As described herein, the magazine guide portion 304 is configured to extend towards the magazine when assembled with the firearm. In some embodiments, the magazine guide portion 304 may be at least partially or completely integrated into trigger guard 102A. For example, in some embodiments the trigger guard 102A, including at least a portion of the magazine guide portion 304, excluding the hardened wear surface 302, may be made of a single piece of material. In some embodiments, the magazine guide portion 304 may at least partially comprise a part connected to trigger guard 102A (e.g., an extrusion welded or otherwise attached to trigger guard 102A, etc.). It should be appreciated, in light of the present disclosure, that the magazine guide portion 304 may be used in place of other magazine guide portion embodiments described herein.

With continued reference to FIG. 4, the depicted hardened wear surface 302 is defined by a hardened pin inserted into a cavity 306 at least partially defined by the magazine guide portion 304. The cavity 306 is shown extending laterally across the width of the magazine guide portion 304 and the trigger guard 102A. The depicted cavity 306 further includes an open channel 308 along the front end of the magazine guide portion 304 through which the hardened wear surface 302 is configured to protrude to engage the magazine. The channel 308 may extend laterally across the width of the magazine guide portion 304 of the trigger guard 102A (e.g., along the full length or a portion of the length of the cavity 306). In some embodiments, the channel 308 may define a height that is less than the height of the hardened wear surface (e.g., the hardened pin) such that the hardened wear surface 302 is captively held by the trigger guard 102A while providing wear reduction via the portion visible through the channel 308. In some embodiments, for example, the hardened pin may comprise one or more of a barrel pin, a roll pin, a needle roller, a dowel, or the like. In some embodiments, the hardened pin may be press fit, glued, or otherwise attached to the trigger guard 102A at the magazine guide portion 304.

In some embodiments, the hardened wear surface 302 may comprise a hardened material defining a first hardness that is greater than a second hardness defined by the remainder of the trigger guard 102A and/or magazine guide portion 304 and/or lower receiver 106 (shown in FIGS. 1-2). In some embodiments, the hardened wear surface 302 may comprise one or more of titanium, tungsten, steel, stainless steel, aluminum, nickel, brass, bronze, chromium, the like, or combinations thereof. In some embodiments, the receiver 106 and remaining portion of the trigger guard 102A may be made of aluminum, and the hardened wear surface 302 may be made of a material harder than aluminum.

In some embodiments, the hardened wear surface 302 may be inserted into, attached to or in, or integrated with the remainder of the trigger guard 102A (e.g., the remainder of the trigger guard may include any portion of the magazine guide portion or main body of the trigger guard) in any manner that causes the hardened wear surface 302 to engage the magazine as necessary during operation. For example, while depicted in FIG. 4 as being inserted laterally perpendicular to the longitudinal axis of the trigger guard 102A, the hardened wear surface may be inserted into the trigger guard along another axis, such as the longitudinal axis, or the hardened wear surface may be glued, welded, or otherwise attached to the forward end of the trigger guard 102A.

In the embodiments depicted in FIGS. 3-4, the magazine guide portions 104, 304 illustrated with cross-hatching in the figures depict additions relative to a stock trigger guard for an example firearm (e.g., an AR-15®, M4, SR25, etc.) without limitation as to the manner in which the magazine guide portions and/or trigger guards are formed.

FIG. 5 illustrates a side isometric view of a lower receiver assembly 400 with a magazine 406 inserted into the magazine well 112 in an operational position and with the magazine retained via the magazine catch receiving opening 114 according to some example embodiments. The lower receiver assembly 400 is illustrated with trigger guard 102, comprising magazine guide portion 104, attached to lower receiver 106 by way of a front fastener and a rear fastener 108. In some embodiments, the front fastener may be located in the forward portion of trigger guard 102 and may connect trigger guard 102 to a forward portion of lower receiver 106 near magazine well 112 via the forward attachment feature 202A shown in FIGS. 3-4, and may comprise the same structure and operation as the rear fastener 108 inserted from the opposite side of the receiver. In some embodiments, trigger guard 102 may be at least partially integrated into lower receiver 106.

As shown in FIG. 5, the magazine 406 may be at least partially in contact with the magazine guide portion 104 according to the embodiments discussed herein, whereby the forces associated with the firearm and/or user, including but not limited to recoil forces, cycling forces, or the like (e.g., operator movements such as running or positioning the firearm, etc.) may cause a magazine supported by the lower receiver within the magazine well to shift (e.g., translate and/or rotate) forward or rearward. Such forward or rearward movements of the magazine can change the feed angle of the next cartridge causing the next cartridge to fail to properly chamber within the firearm as the bolt moves forward to strip the cartridge from the magazine while the magazine is out of position. It should be appreciated, in light of the present disclosure, that the magazine guide portions 104, 304, 804, 904, 1004, 1104, 1204, 1304, 1404, or the like, may be configured to resist rotation, or other movements (e.g., translation, etc.), of the magazine relative to the magazine well 112 to ensure reliable feeding of the cartridges into the chamber and reliable cycling of the firearm.

With reference to FIG. 6, a cross-section of a portion of the firearm 10 is shown. The firearm 10 includes a bolt carrier group 20 and a bolt 22 configured to strip a cartridge 24 from the magazine 406 and feed the cartridge into the chamber 26 for firing. The firearm 10 may include a trigger assembly 28 (e.g., trigger, hammer, disconnector, etc.). The firearm 10 may further include a gas delivery system 30 for directing at least some of the expanding gases generated by firing the chambered cartridge from a location at or near the muzzle to at least force the bolt carrier group 20 rearward causing extraction of the spent cartridge casing from chamber before the subsequently stripping a new cartridge from the magazine and into the chamber, and resetting the trigger assembly 28 as would be appreciated by a person of ordinary skill in the art in light of the present disclosure. The cycling forces from the gas delivery system 30, bolt carrier group 20, and/or other moving components of the firearm may cause at least some of the movement of the magazine addressed by the embodiments of the trigger guard discussed herein. The firearm 10 is equipped with a trigger guard 102 having a magazine guide portion 104 according to various embodiments described herein. With reference to FIGS. 1 and 6, the magazine 406 may be held at least by a magazine catch 18 about which point the magazine may rotate slightly within the magazine well 112 due to the clearance between the well and the magazine.

For example, a recoil action of a firearm 10 may cause a bottom portion of the magazine 406 to move rearward towards the grip 110, thereby causing the upper portion of the magazine 406 to tilt and/or translate forward in absence of the magazine guide portion 104. In some embodiments, contact between the bolt 22 and cartridge 24 may cause the magazine 406 holding the cartridge to rotate forward as the round is stripped from the magazine and fed towards the chamber 26 in absence of the magazine guide portion 104. In such instances, the next cartridge to be chambered by the firearm 10 may be oriented lower relative to a top surface defined by lower receiver 106 of the firearm which may increase the likelihood of the cartridge being improperly loaded into the chamber 26 of the firearm 10. In some embodiments, with or without the effect of movement on the magazine, the magazine 406 and round 24 may need to be angled higher than normal for a stock version of the firearm due to differences in the optimal feed angle of various types of cartridge as described herein.

At least during operation, the magazine guide portion 104 may cause the magazine 406 to position the cartridge 24 at an improved position within the range of the aforementioned rotation for feeding into the chamber 26 relative to a position of the magazine when using a stock trigger guard. Example embodiments comprising a trigger guard 102, 102A-102H with a magazine guide portion 104, 304, 804, 904, 1004, 1104, 1204, 1304, 1404 (e.g., with or without a hardened wear surface) as described herein resist movement of the magazine 406 within the lower receiver's magazine well and keep the cartridge aligned with a more favorable feed angle such that the probability of each cartridge chambering properly is increased. In some embodiments, the magazine guide portion 104 may be in continual contact with the magazine 406 to prevent any forward rotation of the rounds 24, and in some embodiments, the magazine guide portion 104 may limit the range of rotation and resist rotation of the magazine 406 past a certain point relative to a stock trigger guard with or without continual contact.

Thus, the trigger guard 102, 102A-102H, via the magazine guide portion 104, or the like, may, in some embodiments, improve the stability and reliability of feeding of the cartridges and, in some embodiments, may position the next cartridge to be chambered by the firearm in a more upward orientation relative to the top surface defined by lower receiver 106 of the firearm which may increase the likelihood of the cartridge being properly chambered by the firearm. The magazine guide portion 104 may be configured to reduce the amount of wobble (e.g., play, slop, etc.) of the magazine 406 when at least partially engaged by the lower receiver 106. The reduced wobble in the magazine 406 may cause, for example, less undesirable movement of the magazine and/or cartridges held therein during cycling of the action, thus improving firearm reliability (e.g., during cycling operations, magazine reloads, etc.) in addition to and/or independent of a steeper feed angle. In some embodiments, cartridges having a greater necking down difference between the cross-sectional diameters of the bullet and the cartridge case body may experience greater improvements in the reliability of rounds feeding properly into the firearm. This improvement may occur in some embodiments because, for example, wider cartridge cases with a greater the necking down (e.g., tapering) to accommodate a smaller diameter bullet may have a greater likelihood of fouling or catching during cycling due to the height of the shoulder created by the tapering. Notwithstanding the foregoing, the feeding of any type or sized round may be improved by way of the methods and apparatuses described herein.

The inventive principles disclosed herein can be applied to other types of firearms having magazines, including but not limited to other types of rifles, carbines, shotguns, and/or pistols. Non-limiting examples of cartridges for which the inventors have found improved feeding using the embodiments of the trigger guard 102, 102A-102H and magazine guide portion 104, 304, 804, 904, 1004, 1104, 1204, 1304, 1404 described herein include 6.5 mm Grendel and 6 mm ARC rounds.

FIGS. 7A and 7B show an exaggerated difference in feed angle facilitated by a trigger guard 102 comprising a magazine guide portion 104 for illustrative purposes. FIG. 7A illustrates a cross-sectional, schematic side view of an example firearm 500A equipped with a magazine 406. As shown in FIG. 7A, the example firearm 500A comprises a barrel 504, a magazine 406, and a feed ramp 502. The magazine 406 is shown retaining a cartridge 508 that is in position to be chambered into a chamber at least partially defined by the barrel 504 via the feed ramp 502. In some embodiments, the cartridge 508 may be pushed into the feed ramp 502 by at least a bolt 22 (shown in FIG. 6) along a linear path 510A as shown. The feed ramp 502 may be configured to direct the cartridge 508 upward into the chamber at least partially defined by the barrel 504 in order to align the cartridge 508 with a barrel center axis 506. The feed ramp 502 may define a polished surface at least partially configured as part of the barrel 504 and/or a lower receiver (e.g., lower receiver 106 shown in FIGS. 1-2, or the like). During a firearm operational cycle, the cartridge 508 may slide up the polished surface defined by the feed ramp 502.

FIG. 7B illustrates a cross-sectional, schematic side view of an example firearm 500B equipped with a magazine 406, according to some example embodiments. As shown in FIG. 7B, the example firearm 500B comprises a barrel 504, a magazine 406, a feed ramp 502, and a trigger guard 102 having a magazine guide portion 104. The magazine 406 is shown retaining a cartridge 508 that is in position to be chambered into a chamber at least partially defined by the barrel 504 via the feed ramp 502. In some embodiments, the cartridge 508 may be pushed into the feed ramp 502 by at least a bolt 22 (shown in FIG. 6) along a linear path 510B as shown. As between FIGS. 7A and 7B, the linear path 501B of FIG. 7B is angled higher towards the chamber than the linear path 510A of FIG. 7A. As illustrated, the trigger guard 102, 102A-102H configured with magazine guide portion 104, or the like, resists rotation of the magazine 406 (e.g., by gravity, recoil force, or the like) by applying a force (e.g., a reactionary force against the magazine) to produce the linear path 510B for feeding the cartridge 508 more easily into the chamber of the barrel 504.

The feed ramp 502 may be configured to direct the cartridge 508 upward into the chamber at least partially defined by the barrel 504 in order to align the cartridge 508 with a barrel center axis 506. The feed ramp 502 may define a polished surface at least partially configured as part of the barrel 504 and/or a lower receiver (e.g., lower receiver 106, or the like). During a firearm operational cycle, the cartridge 508 may slide up the polished surface defined by the feed ramp 502.

It should be appreciated, in light of the present disclosure, that the amount of friction between the nose of the cartridge 508 and the feed ramp 502 may be reduced by angling the nose of the cartridge 508 upward using the trigger guard 102, 102A-102H assemblies described herein. It should be further appreciated, in light of the present disclosure, that by angling the nose of the cartridge 508 upward the likelihood of a shoulder defined by the cartridge 508 becoming caught on the feed ramp 502, or an edge defined by at junction point between the feed ramp 502 and the barrel 504, may be reduced. Moreover, it should be appreciated, in light of the present disclosure, that by reducing the amount of friction between the nose of the cartridge 508 and the feed ramp 502 and/or by reducing the likelihood of a shoulder defined by the cartridge 508 becoming caught during operation of the firearm that the reliability of both a magazine and the firearm may be increased.

In some embodiments, one or more dimensions of the magazine guide portion (e.g., 104, 304, 804, 904, 1004, 1104, 1204, 1304, 1404, or the like) may be modified (e.g., increased or decreased) to produce a more linear path 510B for the cartridge 508 to travel, to apply a force to the magazine, and/or to constrain the motion of the magazine in a manner that may reduce the likelihood of failed chambering of the cartridge 508.

In some embodiments, the one or more dimensions of the magazine guide portion may be modified based on a cartridge type (e.g., 6 mm ARC, 6.5 mm Grendel, or the like) or a structure of a magazine associated therewith. For example, in some embodiments, one or more geometries (e.g., angles, shapes, etc.) of the magazine guide portion may be modified based on a cartridge type or a magazine associated therewith. In some embodiments, the projection distances of the magazine guide portion of the trigger guard into the magazine well along at least a longitudinal axis of the trigger guard may depend upon the cartridge and/or magazine properties and dimensions. For example, cartridges of particular dimensions may require a steeper angle of the magazine, and exterior contours of the magazines may vary (e.g., differing shapes, additional elements such as a rivet, welds, or protrusion, etc.), each of which may benefit from different projection distances of the magazine guide portion of the trigger guard to achieve a preferred interaction with the magazine.

In some embodiments, different trigger guards may be used to accomplish the appropriate positioning of the magazine and cartridge. In some embodiments, the magazine guide portion may be adjustable, such as by a setscrew, spring and plunger, or other adjustable or replaceable component. The amount of projection distance (e.g., the distance the magazine guide portion projects into the magazine well) associated with the magazine guide portion may be adjusted based on at least a particular cartridge type and/or a structure of the magazine (e.g., to accommodate and/or compensate for an exterior contour, weld, rivet, material characteristic, dent, gouge, protrusion, or the like associated with the body of the magazine). In some embodiments, one or more replaceable portions of the trigger guard may be interchanged to accommodate specific magazines and/or cartridge types. In some embodiments, the magazine guide portion comprises one or more of a hardened wear surface (e.g., relatively harder with respect to at least the hardness of an associated magazine body material), a roller, a setscrew, a press fit insert, a spring clip, or the like.

FIGS. 8A-14C depict additional embodiments of the trigger guards disclosed herein, each of which may be used for the same purposes and functions described for any other embodiments herein. Except as stated otherwise, the firearms, receivers, and trigger guards of the embodiments of FIGS. 8A-14C are generally structured and function the same as and are interchangeable with the other embodiments disclosed herein. The various trigger guards disclosed herein may be interchanged with any other trigger guards disclosed herein. In each of the various embodiments, the depicted magazine guide portions and their associated wear components and/or surfaces may be configured as the forwardmost portion of the trigger guard configured to improve feeding of the magazine for the reasons and benefits described herein.

FIGS. 8A-8C illustrate a cross-sectional side view (FIG. 8B) and a bottom view (FIG. 8C) of a trigger guard 102B and an isometric assembly view (FIG. 8A) of a lower receiver 106 having the trigger guard 102B according to some example embodiments. In the depicted embodiment, the trigger guard 102B includes a setscrew 802 as part of the magazine guide portion 804 at one end. The setscrew 802 of the magazine guide portion 804, as illustrated, is configured to extend forward (e.g., towards the left of the page of FIG. 8B) from the forward portion of the trigger guard 102B along a longitudinal axis defined along the length dimension of the trigger guard 102B. As described herein, the setscrew 802 of the magazine guide portion 804 is configured to extend towards the magazine when assembled with the firearm. As shown, the setscrew 802 is attached to the trigger guard 102B via a threaded hole in the front of the trigger guard 102B.

In some embodiments, the setscrew may comprise one or more of a distal end (e.g., cone, flat, etc.), a head (e.g., hexagon head, etc.) or headless end, a hardened material, a threaded surface (e.g., fine, coarse, metric, etc.), or the like. In some embodiments, the setscrew 802 may be formed of a hardened material relative to the magazine and/or lower receiver 106 to define the hardened wear surface which, by way of non-limiting example, may be structured and may function according to the materials and functions described herein (e.g., the setscrew may be made of a harder material than the lower receiver and/or the magazine to reduce wear caused by contact between the magazine and the setscrew). The setscrew 802 of the magazine guide portion 804 may be configured so that the projection distance (e.g., into the magazine well) of the setscrew magazine guide portion 802 may be adjusted (e.g., increased or decreased) by turning and/or replacing the setscrew component of the setscrew magazine guide portion 802. For example, a longer setscrew may be used in an instance that the feed angle of the magazine needs to be increased or a shorter set screw may be backed out of the threaded hole some amount to project further into the magazine well. In some embodiments, the setscrew magazine guide portion 802 may be configured along one or more lateral positions (e.g., towards the top or bottom of the page of FIG. 8B) along the front end of trigger guard 102B to more easily interface with one or more exterior contours of the magazine (e.g., a rivet, weld, seam, etc.).

FIGS. 9A-9C illustrate a cross-sectional side view (FIG. 9B), a bottom view (FIG. 9C), and a side isometric assembly view (FIG. 9A) of a trigger guard 102C, according to some example embodiments. In the depicted embodiment, the trigger guard 102C includes a plug 902 on the magazine guide portion 904 at one end. The plug 902, as illustrated, is configured to extend forward (e.g., towards the left of the page of FIG. 9B) from the forward portion of the trigger guard 102C along a longitudinal axis defined along the length dimension of the trigger guard 102C. As described herein, the plug 902 of the magazine guide portion 904 is configured to extend towards the magazine when assembled with the firearm. As shown, the plug magazine guide portion 902 comprises a plug inserted into the trigger guard 102C via a hole in the front of the trigger guard 102C. The plug 902 may be structured and may function substantially the same as the setscrew 802 of FIGS. 8A-8C except that the plug 902 may lack threading and may be press-fit or otherwise attached to the trigger guard 102C.

In some embodiments, the plug may define one or more of a distal end (e.g., cone, flat, etc.), a head (e.g., circular head of larger diameter relative to a body of the plug, etc.) or headless end, a hardened material, or the like. In some embodiments, the plug 902 may be formed of a hardened material relative to the magazine and/or lower receiver 106 to define the hardened wear surface which, by way of non-limiting example, may be structured and may function according to the materials and functions described herein (e.g., the plug may be made of a harder material than the lower receiver and/or the magazine to reduce wear caused by contact between the magazine and the plug). The plug 902 of the magazine guide portion 904 may be configured so that the projection distance (e.g., into the magazine well) of the plug 902 may be substantially fixed (e.g., for improved performance with a particular cartridge type and/or magazine type). In some embodiments, multiple plugs 902 may be used interchangeably to achieve different projection distances. For example, a longer plug may be used in an instance that a steeper feed angle is desired, such as for a cartridge with a larger case shoulder (e.g., a larger bullet to case body diameter variation), and/or in an instance that a magazine's rear surface is shaped to require a longer plug to engage. In some embodiments, the plug 902 of the magazine guide portion 904 may be disposed along one or more lateral positions (e.g., towards the top or bottom of the page relative to FIG. 9C) and/or one or more vertical positions (e.g., towards the top or bottom of the page relative to FIG. 9B) along the front end of trigger guard 102C to more easily interface with one or more exterior contours of the magazine (e.g., a rivet, weld, contour, ridge, etc.). In some embodiments, the end of the plug 902 that contacts the magazine may be shaped (e.g., concave, convex, flat, pointed, notched, stepped, etc.) to better interface with the magazine.

FIGS. 10A-10C illustrate a cross-sectional side view (FIG. 10B), a bottom view (FIG. 10C), and an isometric assembly view (FIG. 10A) of a trigger guard 102D, according to some example embodiments. In the depicted embodiment, the trigger guard 102D includes an insert 1002 at least partly defining the magazine guide portion 1004 at one end. The insert 1002, as illustrated, is configured to extend forward (e.g., towards the left of the page of FIG. 10B) from the forward portion of the trigger guard 102D along a longitudinal axis defined along the length dimension of the trigger guard 102D. As described herein, the insert magazine guide portion 1002 is configured to extend towards the magazine when assembled with the firearm. The depicted insert 1002 of the magazine guide portion 1004 may be configured to define at least one or more of attachment features 202A, 202B of the trigger guard 102D, which may increase the rigidity between the magazine guide portion and the rest of the receiver assembly. The insert 1002 may include a forward projection 1008 defining the contact portion of the magazine guide surface 1004 and a rear projection 1006 extending rearward from the attachment feature 202A, which may provide additional structure and rigidity to the trigger guard. For example, the trigger guard 102D may be manufactured by overmolding polymer onto the insert 1002, such that the insert 1002 provides rigidity and durability to an otherwise polymer trigger guard. As shown, the insert magazine guide portion 1002 comprises a portion of the forward attachment feature 202A, an insert configured to fit into the trigger guard 102D via a void in the front of the trigger guard 102D. In some embodiments, the insert 1002 may extend partially, entirely, or substantially entirely across the width of the trigger guard 102D.

In some embodiments, the insert 1002 may be formed of a hardened material relative to the magazine and/or lower receiver 106 to define the hardened wear surface which, by way of non-limiting example, may be structured and may function according to the materials and functions described herein (e.g., the insert may be made of a harder material than the lower receiver and/or the magazine to reduce wear caused by contact between the magazine and the insert). The insert 1002 may be configured to at least partially conform to the shape of the void in the front of the trigger guard 102D (e.g., by overmolding the rest of the trigger guard around the insert, or any other means for fitting the insert into the trigger guard). The insert 1002 of the magazine guide portion 1004 may be configured so that the projection distance (e.g., into the magazine well) of the insert magazine guide portion 1002 may be substantially fixed (e.g., for improved performance with a particular cartridge type and/or a particular magazine). In some embodiments, the insert 1002 may be a steel insert connected to a polymer trigger guard (e.g., trigger guard 102D) via one or more fasteners (e.g., a roll pin, spring and plunger, bolt, screw, or the like).

FIGS. 11A-11C illustrate a cross-sectional side view (FIG. 11B), a bottom view (FIG. 11C), and an isometric assembly view (FIG. 11A) of trigger guard 102E, according to some example embodiments. In the depicted embodiment, the trigger guard 102E includes a dovetail insert 1102 at the magazine guide portion 1104 at one end. The dovetail insert 1102, as illustrated, is configured to project forward (e.g., towards the left of the page of FIG. 11B) from the forward portion of the trigger guard 102E along a longitudinal axis defined along the length dimension of the trigger guard 102E to engage the magazine in the magazine well for the purposes discussed herein. In some embodiments, the dovetail insert 1102 may extend partially, entirely, or substantially entirely across the width of the trigger guard 102E.

As described herein, the dovetail insert 1102 at the magazine guide portion 1104 may be configured to extend towards the magazine when assembled with the firearm. As shown, the dovetail insert 1102 is configured to fit (e.g., press fit in the lateral direction, etc.) into the trigger guard 102E via a dovetailed shaped channel along the forward portion of the trigger guard 102E. In some embodiments, the dovetail may comprise one or more of a contact portion (e.g., flat, rounded, etc.), a hardened material, and/or the like. In some embodiments, the dovetail insert 1102 may be formed of a hardened material relative to the magazine and/or lower receiver 106 to define the hardened wear surface which, by way of non-limiting example, may be structured and may function according to the materials and functions described herein (e.g., the insert may be made of a harder material than the lower receiver and/or the magazine to reduce wear caused by contact between the magazine and the insert). In some embodiments, the dovetail insert 1102 may be a steel (or other hardened material) dovetailed insert that is pressed (e.g., a bonded press fit, interference press fit, etc.) into an aluminum trigger guard (e.g., trigger guard 102E).

FIGS. 12A-12C illustrate a cross-sectional side view (FIG. 12B), a bottom view (FIG. 12C), and an isometric assembly view (FIG. 12A) of a trigger guard 102F, according to some example embodiments. In the depicted embodiment, the trigger guard 102F includes a guide portion 1204 comprising an adjustable wear surface 1202 attached at one end via fastener 1208 and channel 1206. The adjustable wear surface 1202, as illustrated, is configured to extend forward (e.g., towards the left of the page of FIG. 12B) from the forward portion of the trigger guard 102F along a longitudinal axis defined along the length dimension of the trigger guard 102F. As described herein, the adjustable wear surface 1202 is configured to extend towards the magazine when assembled with the firearm. As shown, the adjustable wear surface 1202 comprises a plate configured to fit into the trigger guard 102F via a cutout along the forward and/or bottom portions of the trigger guard 102F. The depicted plate is substantially "L" shaped and defines a vertical or substantially vertical contact portion configured to engage the magazine during use, and a horizontal or substantially horizontal portion configured to define the channel 1206 and slide relative to the fastener 1208 and the remainder of the trigger guard 102F. In some embodiments, the adjustable wear surface 1202 may comprise a spring clip that flexes against the magazine.

In some embodiments, the plate may comprise one or more of a contact portion (e.g., flat, rounded surface, etc.), a hardened material (e.g., spring steel, etc.), an axial channel or cutout (e.g., channel 1206 configured to accept the fastener 1208), and/or the like. In some embodiments, the adjustable wear surface 1202 may be formed of a hardened material relative to the magazine and/or lower receiver 106 to define the hardened wear surface which, by way of non-limiting example, may be structured and may function according to the materials and functions described herein (e.g., the adjustable wear surface may be made of a harder material than the lower receiver and/or the magazine to reduce wear caused by contact between the magazine and the adjustable wear surface). The fastener 1208 may include one or more of a screw (e.g., machine screw, etc.), bolt, pin, or the like. The adjustable wear surface 1202 may be configured to adjust (e.g., increase or decrease) an associated projection distance via at least the fastener 1208 positioned in the channel 1206. For example, the fastener 1208 may be loosened (e.g., via a screwdriver or the like) and the plate of adjustable wear surface 1202 may be extended forward (e.g., towards the left of the page of FIG. 12B) or rearward along channel 1206 to respectively increase or decrease the projection distance and then the fastener 1208 may be tightened (e.g., via a screwdriver or the like) to releasably restrict additional movement of the adjustable wear surface 1202.

FIGS. 13A-13C illustrate a cross-sectional side view (FIG. 13B), a bottom view (FIG. 13C), and an isometric assembly view (FIG. 13A) of trigger guard 102G, according to some example embodiments. In the depicted embodiment, the magazine guide portion 1304 of the trigger guard 102G includes a roller 1302 attached at one end via a shaft 1308. The roller 1302 of the magazine guide portion 1304, as illustrated, is configured to extend forward (e.g., towards the left of the page of FIG. 13B) from the forward portion of the trigger guard 102G along a longitudinal axis defined along the length dimension of the trigger guard 102G. As described herein, the roller 1302 may be configured to extend towards the magazine when assembled with the firearm. As shown, the roller 1302 (e.g., needle roller, hollow steel cylinder, etc.) may be configured to attach to the trigger guard 102G via the shaft 1308. During operation, relative movement between the trigger guard 102G and the magazine may cause the roller to spin to reduce vertical, friction forces between the magazine guide portion 1304 and the magazine, while not reducing the axial forces applied by the trigger guard 102G to achieve the improved magazine feeding described herein.

In some embodiments, the shaft 1308 may be attached to the trigger guard 102G via one or more holes in the trigger guard 102G. For example, the shaft 1308 may be attached to the trigger guard 102G (e.g., press fit, threaded and screwed, etc.). In some embodiments, the shaft 1308 may be molded into a polymer trigger guard (e.g., via one or more injection molding processes, via a heat staking process, etc.).

In some embodiments, the roller 1302 may comprise an internal channel configured to accept at least the shaft 1308. In some embodiments, the roller 1302 may comprise a hardened material (e.g., polished steel, etc.). In some embodiments, the roller 1302 may be formed of a hardened material relative to the magazine and/or lower receiver 106 to define the hardened wear surface which, by way of non-limiting example, may be structured and may function according to the materials and functions described herein (e.g., the roller may be made of a harder material than the lower receiver and/or the magazine to reduce wear caused by contact between the magazine and the roller). The shaft 1308 may comprise a hardened material (e.g., polished steel, etc.). In some embodiments, the shaft 1308 may be at least partially integrated into the roller 1302.

FIGS. 14A-14C illustrate a cross-sectional side view (FIG. 14B), a bottom view (FIG. 14C), and an isometric assembly view (FIG. 14A) of a trigger guard 102H, according to some example embodiments. In the depicted embodiment, the magazine guide portion 1404 of the trigger guard 102H includes a roller 1402 attached at one end of the trigger guard via a shaft 1408. The roller 1402, as illustrated, is configured to extend forward (e.g., towards the left of the page of FIG. 14B) from the forward portion of the trigger guard 102H along a longitudinal axis defined along the length dimension of the trigger guard 102H. As described herein, the roller 1402 is configured to extend towards the magazine when assembled with the firearm. As shown, the roller 1402 (e.g., needle roller, hollow steel cylinder, etc.) configured to attach to the trigger guard 102H via the shaft 1408.

The roller 1402 may be configured to engage a spring 1406 along the longitudinal axis of the trigger guard 102H, which spring may bias the roller in the forward direction to maintain a more continuous contact between the magazine and the roller (e.g., similar to the spring clip discussed herein). The spring 1406 is configured to slidably fit into a recess in the trigger guard 102H as shown in FIG. 14B. The spring 1406 may be configured to keep forward tension (e.g., towards the left of the page of FIG. 14B) on the roller 1402 during operation to allow the roller to maintain better contact with the magazine. In some embodiments, there may be a clearance between the roller 1402 and the shaft 1408 to allow the roller to move relative to the shaft upon the application of forces from the spring 1406 and/or the magazine. In some embodiments, the shaft 1408 may be disposed in a slot oriented in the axial direction to allow the shaft 1408 and roller 1402 to move with the spring 1406.

In some embodiments, the spring 1406 may be configured with a shaft (e.g., to guide the spring 1406 and prevent binding against the walls of the recess in trigger guard 102H that houses the spring). In some embodiments, the spring 1406 may be configured to directly contact the roller 1402 or the spring 1406 may be configured to push a plunger or other intermediate object to contact the roller 1402. In some embodiments, the roller 1402, via at least contact with spring 1406, may provide a continuous or substantially continuous force on the magazine in an instance in which the magazine is inserted into the magazine well. In some embodiments, the spring 1406 may at least partially resist rotation of the roller 1402.

In some embodiments, the shaft 1408 may be attached to the trigger guard 102H via one or more holes and/or slots in the trigger guard 102H. For example, the shaft 1408 may be pressed into the trigger guard 102H (e.g., a press fit, etc.) or the shaft 1408 may be at least partially threaded and screwed into the trigger guard 102H. In some embodiments, the shaft 1408 may be molded into a polymer trigger guard (e.g., via one or more injection molding processes, via a heat staking process, etc.). In some embodiments, the shaft 1408 may be at least partially integrated into the roller 1402. For example, the roller magazine guide portion 1402 may comprise an extrusion on either end of the roller (e.g., a solid cylindrical roller) and the extrusions may be configured to interface (e.g., loosely to facilitate rotational movement) with holes in the trigger guard 102H.

In some embodiments, the roller 1402 may comprise an internal channel configured to accept at least the shaft 1408. In some embodiments, the roller 1402 may comprise a hardened material (e.g., polished steel, etc.). In some embodiments, the roller 1402 may be formed of a hardened material relative to the magazine and/or lower receiver 106 to define the hardened wear surface which, by way of non-limiting example, may be structured and may function according to the materials and functions described herein (e.g., the roller may be made of a harder material than the lower receiver and/or the magazine to reduce wear caused by contact between the magazine and the roller). The shaft 1408 may comprise a hardened material (e.g., polished steel, etc.).

In some embodiments, the trigger guards 102, 102A-H described herein and associated assemblies may be manufactured according to known methods in the art when modified in light of the present disclosure, such as casting, milling, forging, stamping, extruding, injection molding, additive manufacturing, press fitting, heat staking, the like or combinations thereof. In some embodiments, the trigger guards 102, 102A-H described herein and associated assemblies may be manufactured and/or sold separately from an existing firearm 10 and used to retrofit an existing firearm for improved performance and/or use with additional ammunition types.

For example, one or more of the trigger guards 102, 102A-H and/or associated assemblies may be sold such as in sets with magazines and/or ammunition. The sets may be customized for and associated with a particular cartridge type and/or magazine. For example, an embodiment of the trigger guard (e.g., trigger guard 102C shown in FIGS. 9A-9C) may be configured with a plug magazine guide portion 902 providing a particular projection distance configured specifically to improve performance of the 6.5 mm Grendel cartridge. Such an embodiment of the trigger guard 102C, for example, may be sold as part of a set with one or more boxes of 6.5 mm Grendel ammunition and/or one or more magazines configured for the 556 6.5 mm Grendel cartridge.

Moreover, multiple trigger guards (e.g., 102, 102A-H) may be packaged and sold as sets. In such embodiments, various benefits may be achieved, such as providing trigger guards that are configured to work optimally with multiple cartridge and/or magazine types, providing multiple trigger guards to allow a user to fine tune the firearm's performance with a particular cartridge and/or magazine type, or the like. For example, multiple embodiments of a trigger guard (e.g., trigger guard 102D shown in FIGS. 10A-10C) may be sold together, each configured with a wear surface (e.g., an insert 1002) configured for a particular cartridge. In embodiments with removable components, such as, by way of non-limiting example, the setscrew 802 of FIGS. 8A-8C or the adjustable wear surface 1202 of FIGS. 12A-12C, the individual removable components may be sold in sets and/or replaced instead of or in addition to the entire trigger guards. In some embodiments, a trigger guard 102, 102A-H associated with a particular cartridge type or magazine type may be marked with an indication of that respective cartridge type or magazine type. For example, a trigger guard associated with the 0.556 NATO cartridge may be labeled (e.g., engraved, etched, printed, painted or otherwise marked with "0.556 NATO" or a symbol representative thereof).

A plurality of trigger guards may be manufactured and sold with magazine guide portions defining different projection distances from the front attachment feature to more precisely customize the positioning of the magazine for different ammunition types and/or different magazine types (e.g., different makes and models). The trigger guards 102, 102A-H may be packaged and/or sold with replacement components or replacement components may be sold separately (e.g., to alter a trigger guard in such a way that it functions best with a particular cartridge, to replace a worn or broken portion of the trigger guard, etc.). By way of non-limiting example, if a adjustable wear surface 1202 is lost (e.g., dropped in a field, etc.) or damaged (e.g., bent, etc.) a new/replacement adjustable wear surface 1202 may be purchased (e.g., alone or in a package including at least fastener 1208 and/or thread lock adhesive). In some embodiments, one or more trigger guards 102, 102A-H may be packaged and sold with a firearm to allow a user options for fine tuning the weapon's performance immediately.

The embodiments described herein may also be scalable to accommodate at least the aforementioned applications. Various components of embodiments described herein can be added, removed, reorganized, modified, duplicated, and/or the like as one skilled in the art would find convenient and/or necessary to implement a particular application in conjunction with the teachings of the present disclosure. Moreover, specialized features, characteristics, materials, components, and/or equipment may be applied in conjunction with the teachings of the present disclosure as one skilled in the art would find convenient and/or necessary to implement a particular application in light of the present disclosure.

Many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated, in light of the present disclosure, that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

The invention claimed is:

1. An assembly for positioning a magazine within a firearm, comprising:

a receiver defining a magazine well configured to support a magazine during a firearm operational cycle; and a trigger guard connected to the receiver, wherein the trigger guard comprises a magazine guide portion, wherein the magazine guide portion of the trigger guard is configured to contact the magazine supported by the receiver during at least a portion of the firearm operational cycle to resist rotation of the magazine relative to the magazine well, wherein the magazine guide portion comprises a hardened material defining a first hardness that is greater than a second hardness of the receiver.

2. The assembly of claim 1, wherein the hardened material is attached to a remainder of the trigger guard.

3. The assembly of claim 2, wherein the hardened material is press fit into an opening in the remainder of the trigger guard, the opening defining a slot along a width of the trigger guard through which a portion of the hardened material is configured to protrude.

4. The assembly of claim 1, wherein the receiver comprises aluminum, and wherein the hardened material comprises one or more of titanium, tungsten, steel, stainless steel, nickel, brass, bronze, or chromium.

5. The assembly of claim 1, wherein the magazine guide portion protrudes at least partially into the magazine well via a slot defined by the receiver.

6. The assembly of claim 1, wherein the trigger guard comprises a forward portion and a rear portion, and wherein the magazine guide portion is defined at the forward portion of the trigger guard.

7. The assembly of claim 6, wherein the magazine guide portion defines a projection extending along a longitudinal axis of the trigger guard from a forward attachment feature of the trigger guard.

8. The assembly of claim 6, wherein the forward portion of the trigger guard is configured with a forward attachment feature that comprises a hole configured to receive a fastener for securing the trigger guard to the receiver, and wherein the rear portion of the trigger guard is configured with a rear attachment feature that comprises a hole configured to receive a fastener for securing the trigger guard to the receiver.

9. The assembly of claim 6, wherein the trigger guard extends across a recess of the receiver configured to receive at least a trigger, and wherein the trigger guard is configured to prevent inadvertent actuation of the trigger.

10. The assembly of claim 1, wherein the magazine defining one or more feed lips configured to hold a cartridge in a loading position for receipt by a chamber of the firearm during the firearm operational cycle.

11. The assembly of claim 1 further comprising a magazine catch configured to hold the magazine within the magazine well of the receiver.

12. The assembly of claim 11, wherein the trigger guard is configured to allow the magazine to release from the receiver when the magazine catch is released.

13. The assembly of claim 1, wherein the firearm operational cycle comprises a cartridge being stripped from the magazine by a bolt and fed into a chamber via a feed ramp defining a cartridge feed angle relative to a center axis of the chamber of the firearm, and wherein the feed ramp is configured to at least partially contact the cartridge during the firearm operational cycle and direct the cartridge into the chamber.

14. The assembly of claim 1, wherein the magazine guide portion comprises a setscrew or a plug inserted into the trigger guard.

15. The assembly of claim 1, wherein the magazine guide portion comprises an insert disposed at least partially within a remainder of the trigger guard.

16. The assembly of claim 15, wherein the insert is molded into the trigger guard.

17. The assembly of claim 1, wherein the magazine guide portion comprises an adjustable wear surface configured to be moved between two or more axial positions.

18. The assembly of claim 1, wherein the magazine guide portion comprises a roller configured to engage the magazine.

19. A trigger guard for a firearm comprising:

a magazine guide portion, wherein the magazine guide portion comprises a hardened material, wherein the trigger guard is configured to attach to a receiver of the firearm, wherein the magazine guide portion is configured to contact a magazine supported by the receiver during at least a portion of the firearm operational cycle to resist rotation of the magazine relative to the magazine well.

20. The trigger guard of claim 19 further defining a forward attachment hole and a rearward attachment hole each configured to receive a fastener therethrough for securing the trigger guard to the receiver.

21. The trigger guard of claim 20, the magazine guide portion defines a projection extending along a longitudinal axis of the trigger guard from the forward attachment feature of the trigger guard.

22. The trigger guard of claim 19, wherein the magazine guide portion comprises a hardened material attached to a remainder of the trigger guard.

23. A firearm comprising the assembly of claim 1.

24. The firearm of claim 23, further comprising the magazine and a magazine catch;

wherein the magazine disposed in the magazine well and held by the magazine catch, wherein a clearance is defined between at least a portion of the magazine and at least a portion of the magazine well, and wherein the magazine is prevented from rotating into at least a portion of the clearance by the magazine guide portion of the trigger guard.

25. The firearm of claim 24, wherein the hardened material of the magazine guide portion defines a first hardness that is greater than a second hardness of the magazine.

26. A method of manufacturing a trigger guard for a firearm, the method comprising:

forming the trigger guard including forming a magazine guide portion, wherein the trigger guard is configured to attach to a receiver of the firearm, wherein the magazine guide portion is configured to contact a magazine supported by the receiver during at least a portion of the firearm operational cycle to resist rotation of the magazine relative to the magazine well, wherein the magazine guide portion comprises a hardened material defining a first hardness that is greater than a second hardness of the magazine.

27. A method of manufacturing an assembly for positioning a magazine within a firearm, the method comprising:

performing the method of claim 26 to manufacture the trigger guard for the firearm;

connecting the trigger guard to a receiver defining a magazine well configured to support a magazine during a firearm operational cycle.

28. A method of manufacturing a firearm, the method comprising:

performing the method of claim 27 to manufacture the assembly for positioning the magazine within the firearm;

connecting the assembly directly or indirectly with at least a bolt carrier group, a trigger assembly, and a gas delivery system.

29. The assembly of claim 1, wherein the magazine guide portion comprises a cavity through which a hardened wear surface is received, wherein at least a portion of the hardened wear surface is exposed along at least a portion of a length of the cavity, and wherein the at least a portion of the hardened wear surface is configured to contact the magazine supported by the receiver during at least a portion of the firearm operational cycle.

* * * * *